US012240725B2

(12) United States Patent
Hyodo

(10) Patent No.: US 12,240,725 B2
(45) Date of Patent: Mar. 4, 2025

(54) SHEET DISCHARGE APPARATUS AND IMAGE FORMING SYSTEM

(71) Applicant: CANON KABUSHIKI KAISHA, Tokyo (JP)

(72) Inventor: Taisuke Hyodo, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 18/055,768

(22) Filed: Nov. 15, 2022

(65) Prior Publication Data

US 2023/0159297 A1 May 25, 2023

(30) Foreign Application Priority Data

Nov. 22, 2021 (JP) ..... 2021-189216

(51) Int. Cl.
*B65H 29/00* (2006.01)
*B65H 43/00* (2006.01)

(52) U.S. Cl.
CPC ..... *B65H 43/00* (2013.01); *B65H 29/00* (2013.01)

(58) Field of Classification Search
CPC ..... B65H 29/00; B65H 29/12; B65H 29/20; B65H 29/58; B65H 43/00; B65H 2403/80; B65H 2403/82; B65H 2513/10
USPC ..... 271/202, 270
See application file for complete search history.

(56) References Cited

U.S. PATENT DOCUMENTS

| | | | | |
|---|---|---|---|---|
| 7,874,551 | B2 * | 1/2011 | Iguchi | B65H 31/3081 270/58.11 |
| 9,932,194 | B2 * | 4/2018 | Tokuma | B65H 43/08 |
| 10,315,880 | B2 * | 6/2019 | Nakano | B65H 29/145 |
| 11,086,261 | B2 * | 8/2021 | Endo | G03G 15/6582 |
| 11,434,099 | B2 * | 9/2022 | Furumido | B65H 43/00 |

FOREIGN PATENT DOCUMENTS

| | | | |
|---|---|---|---|
| JP | H06099070 | B2 | 12/1994 |
| JP | 2018034981 | A | 3/2018 |
| JP | 2019182600 | A | 10/2019 |
| JP | 2021191703 | A | 12/2021 |

* cited by examiner

*Primary Examiner* — Leslie A Nicholson, III
(74) *Attorney, Agent, or Firm* — Canon U.S.A., Inc., IP Division

(57) ABSTRACT

The sheet discharge apparatus sets a discharge speed at which a sheet is discharged by a discharge device to a first discharge speed when a bundle of sheets includes a first number of sheets and sets the discharge speed to a second discharge speed that is lower than the first discharge speed when the bundle of sheets includes a second number of sheets that is greater than the first number of sheets.

7 Claims, 12 Drawing Sheets

| NUMBER OF SHEETS IN BUNDLE | DISCHARGE SPEED V3 |
|---|---|
| 2 | $V3_1$ |
| 3 | $V3_1$ |
| 4 | $V3_1$ |

SETTING OF DISCHARGE SPEED V3

| NUMBER OF SHEETS IN BUNDLE | DISCHARGE SPEED V3 |
|---|---|
| 2 | $V3_1$ |
| 3 | $V3_1$ |
| 4 | $V3_1$ |

SETTING OF DISCHARGE SPEED V3

| NUMBER OF SHEETS IN BUNDLE | DISCHARGE SPEED V3 |
|---|---|
| 2 | $V3_2$ |
| 3 | $V3_3$ |
| 4 | $V3_4$ |

SETTING OF DISCHARGE SPEED V3

| NUMBER OF SHEETS IN BUNDLE | DISCHARGE SPEED V3 |
|---|---|
| 2 | $V3_2$ |
| 3 | $V3_3$ |
| 4 | $V3_4$ |

SETTING OF DISCHARGE SPEED V3

| NUMBER OF SHEETS IN BUNDLE | DISCHARGE SPEED V3 |
|---|---|
| 2 | $V3_2$ |
| 3 | $V3_3$ |
| 4 | $V3_4$ |

SETTING OF DISCHARGE SPEED V3

SHEET DISCHARGE APPARATUS AND IMAGE FORMING SYSTEM

BACKGROUND OF THE INVENTION

Field of the Invention

The present invention relates to a sheet discharge apparatus that discharges a sheet and an image forming system that forms an image on a sheet.

Description of the Related Art

A sheet processing device (also referred to as a finisher) that performs processes, such as sorting, binding, and alignment, on sheets having images formed thereon has been developed as an option for image forming apparatuses, such as electrophotographic copying machines and laser beam printers. Some sheet processing devices have the configuration in which when continuously processes a plurality of sheet bundles, the sheet processing device temporarily stops receiving a sheet from an image forming apparatus to wait for the end of the previous sheet bundle process. In this case, the productivity (the throughput) of the image forming system decreases.

Therefore, a method is proposed for stacking a sheet received from the image forming apparatus in the sheet processing device to temporarily hold (buffer) the sheet during processing a sheet bundle and after the processing of sheet bundle is finished, placing the sheet on a processing tray as a sheet bundle. Japanese Patent Publication No. 06-099070 describes the configuration in which a sheet received from an image forming apparatus is held using two conveying paths branched inside a finisher, and the two sheets are overlapped and stacked on a processing tray.

However, if the sheet conveying speed is increased to further improve the productivity of the image forming system, the sheet is discharged at high speed from the image forming apparatus or the sheet processing device and, thus, it is likely that the placement positions of the sheets discharged to the discharge destination, such as a discharge tray, are not the same.

SUMMARY OF THE INVENTION

According to one aspect of the present invention, a sheet discharge apparatus includes a first stacking member provided outside an apparatus main body, a first conveying device disposed in a first conveying path extending toward the first stacking member in the apparatus main body, wherein the first conveying device conveys a sheet to the first stacking member, a discharge device configured to receive the sheet conveyed by the first conveying device and discharge the sheet to the first stacking member, wherein the discharge device discharges a plurality of the sheets each conveyed from the first conveying device in the form of a bundle of sheets, a sheet processing device configured to receive a sheet that is not discharged by the discharge device and processes the received sheet, a second stacking member provided outside the apparatus main body, wherein the sheet processed by the sheet processing device is stacked on the second stacking member, and a controller configured to control the first conveying device and the discharge device to perform a bundle discharge operation for discharging the bundle of sheets from the discharge device onto the first stacking member. The controller sets a discharge speed at which a sheet is discharged by the discharge device to a first discharge speed when the bundle of sheets includes a first number of sheets and sets the discharge speed to a second discharge speed that is lower than the first discharge speed when the bundle of sheets includes a second number of sheets that is greater than the first number of sheets.

Further features of the present invention will become apparent from the following description of exemplary embodiments with reference to the attached drawings.

DESCRIPTION OF THE EMBODIMENTS

Exemplary embodiments of the present invention are described below with reference to the accompanying drawings.

Figure 1:
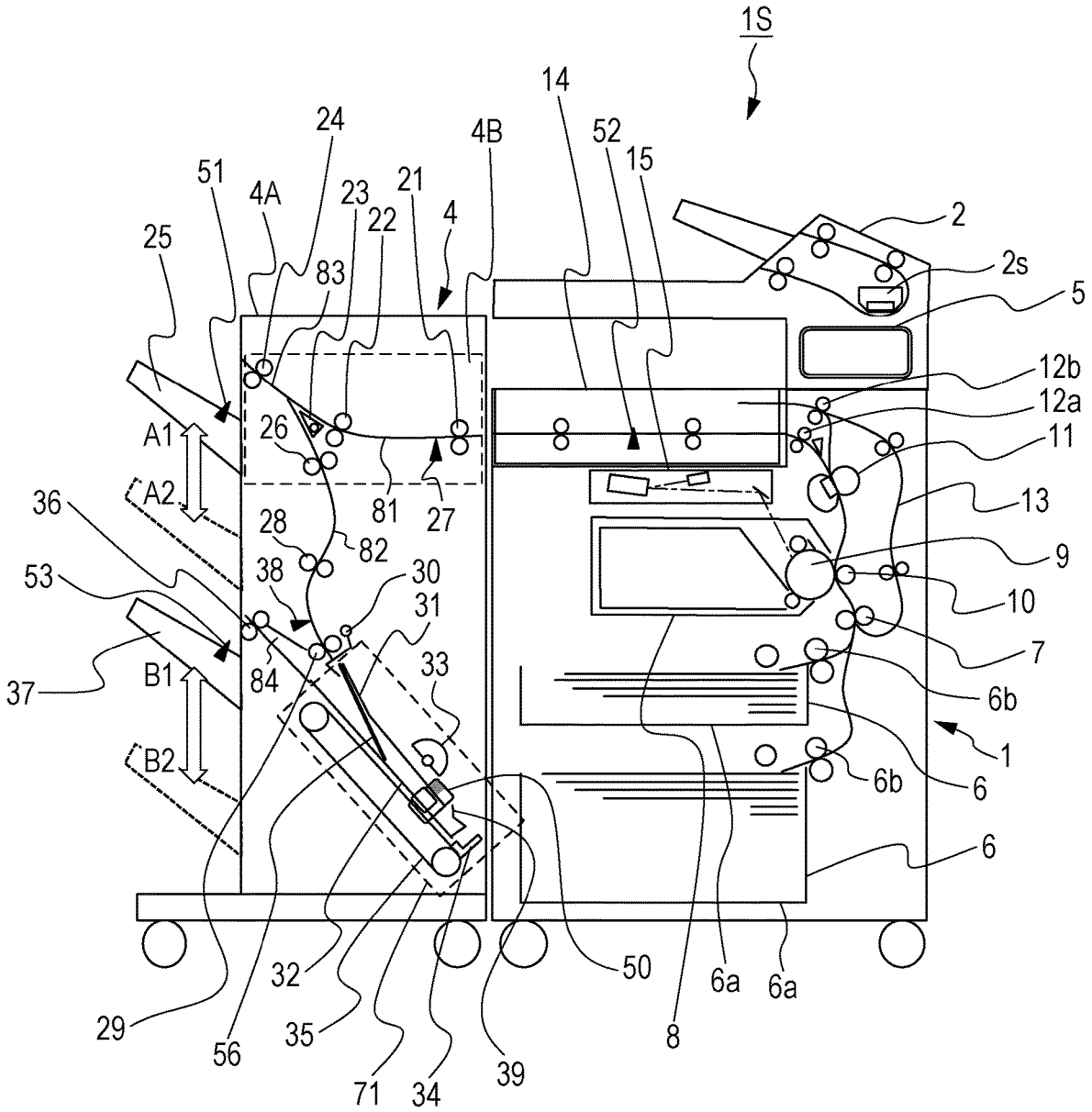
FIG. 1 is a schematic illustration of an image forming system according to an embodiment of the present disclosure.

FIG. 1 is a schematic illustration of an image forming system 1S according to the present embodiment, viewed from the front side. The image forming system 1S includes an image forming apparatus 1 that forms an image on a sheet, a sheet processing apparatus 4 that processes a sheet having, thereon, an image formed by the image forming apparatus 1, a relay unit 14 that conveys the sheet from the image forming apparatus 1 to the sheet processing apparatus 4, and an image reading device 2. A variety of sheets (print media) of different sizes and materials can be used. Examples of a sheet include paper, such as plain paper and thick paper, surface-treated sheet materials, such as a plastic film, fabric, and coated paper, and specially shaped sheet materials, such as envelopes and index paper. The operation performed by each of devices constituting the image forming system 1S is briefly described and, subsequently, the operation performed by the sheet processing apparatus 4 is described in detail below.

The image forming apparatus 1 includes an electrophotographic image forming unit 8 for forming an image, and a feeding device 6 for feeding sheets to the image forming unit 8 one by one. The image forming unit 8 is a cartridge integrally incorporating a photosensitive drum 9, which is an image bearing member (an electrophotographic photosensitive member), and a charging device and a developing device for performing an electrophotographic process by acting on the photosensitive drum 9. A scanner unit 15 serving as an exposure device is disposed above the image forming unit 8, and a transfer roller 10 serving as a transfer device is disposed at a position facing the photosensitive drum 9. A fixing device 11, discharge rollers 12*a*, and reverse rollers 12*b* are disposed above the transfer roller 10. The fixing device 11 has a heat fixing configuration and includes, for example, a cylindrical film, a heater unit that includes a heater and that is disposed inside the film, and a pressure roller in pressure contact with the heater via the film.

A plurality of feeding devices 6 for feeding sheets are disposed below the image forming unit 8. Each of the feeding devices 6 includes a cassette 6*a* serving as a storage unit (a storage box) for storing a plurality of sheets and a feeding unit 6*b* for feeding sheets one by one from the cassette 6*a*.

When the image forming apparatus 1 performs an image forming operation, the surface of the photosensitive drum 9 is uniformly charged by the charging device in the image forming unit 8, and the scanner unit 15 emits a laser beam to the surface of the photosensitive drum 9 on the basis of image information and forms an electrostatic latent image. The electrostatic latent image is developed (visualized) with toner serving as a developer supplied from the developing device, and a toner image is formed on the surface of the photosensitive drum 9.

In parallel with the operation performed by the image forming unit 8, sheets are fed one by one from the cassette 6*a* by the feeding unit 6*b* in any of the feeding devices 6 and are conveyed toward registration rollers 7. After correcting the skew of the sheet, the registration rollers 7 feed the sheet to a transfer portion between the photosensitive drum 9 and the transfer roller 10 in synchronization with the formation of the toner image by the image forming unit 8. Then, the toner image is transferred from the photosensitive drum 9 to the sheet in the transfer portion.

The sheet that has passed through the transfer portion is delivered to the fixing device 11. In the fixing device, when the sheet is nipped by the film and the pressure roller and passes through a fixing nip (a nip between the heater unit and the pressure roller), the toner on the sheet is heated and pressurized. Thus, a toner image is fixed onto the sheet.

In the case of single-sided printing, the sheet that has passed through the fixing device 11 is discharged from the image forming apparatus 1 by the discharge rollers 12*a* and is received by the relay unit 14. In the case of double-sided printing, the sheet having a toner image formed on the first side and having passed through the fixing device 11 is guided by the reverse rollers 12*b*, is switched back by the reverse rollers 12*b*, and is conveyed again to the registration rollers 7 via a re-conveying path 13. Thereafter, an image is formed on a second side opposite to the first side by passing through the transfer portion and the fixing device 11, and the sheet is delivered to the relay unit 14 by the discharge rollers 12*a*.

The image reading device 2 is attached to the top of the image forming apparatus 1. The image reading device 2 includes a reading sensor 2*s* that reads image information from an original and an original conveying unit that conveys the originals one by one to the reading sensor 2*s*. The image forming apparatus 1 can perform both a copying operation of forming an image based on image information acquired by the image reading device 2 and a printing operation of forming an image based on image information received from the outside of the image forming apparatus 1.

According to the present embodiment, the relay unit 14 is disposed in a space (also referred to as an internal discharge space) between the image forming apparatus 1 and the image reading device 2 in the vertical direction (the vertical direction when the image forming system 1S is installed on a horizontal plane). The relay unit 14 conveys the sheet discharged from the image forming apparatus 1 in a substantially horizontal direction viewed from the front side, toward the sheet processing apparatus 4 that is installed alongside of the image forming apparatus 1 on a common installation surface with the image forming apparatus 1. The relay unit 14 includes a sheet sensor 52 serving as a detection unit for detecting passage of a sheet. The sheet sensor 52 is, for example, a reflective photosensor that emits infrared light onto the conveying path and detects light reflected by a sheet passing through the conveying path to determine the presence of the sheet. While the image forming system 15 including the relay unit 14 is used as an example, a sheet may be delivered directly from the image forming apparatus 1 to the sheet processing apparatus 4.

Furthermore, the image forming apparatus 1 includes a display unit 5 (an operation unit, an operation display unit) that serves as a user interface of the image forming system 1S. The display unit 5 has a function of displaying the operation status of the system, such as paper jamming and malfunction and an instruction for the user to perform an operation, such as replacement of consumables in the apparatus and removal of a jammed sheet. The user can operate the touch panel function of a display of the display unit 5, numeric keys, and the like to perform various settings and provide instructions to the image forming system 1S.

Note that the configuration of the image forming apparatus is not limited to the direct transfer system illustrated in FIG. 1. The configuration may be an intermediate transfer system in which a toner image formed in the image forming unit is transferred onto a sheet via an intermediate transfer member. The image forming apparatus may be a color image forming apparatus using a plurality of image forming units. In addition, the image forming mechanism is not limited to the electrophotographic method, and may employ, for example, an inkjet printing unit or an offset printing mechanism.

Sheet Processing Apparatus

The sheet processing apparatus 4 includes a sheet processing device 71 that processes a sheet. The sheet processing apparatus 4 has a function of discharging, as a processing result, sheets that are received from the image forming apparatus 1 and are processed by the sheet processing device 71. Alternatively, the sheet processing apparatus 4 can discharge, as a processing result, sheets received from the image forming apparatus 1 without performing a binding process.

The sheet processing apparatus 4 includes a receiving path 81, an internal discharge path 82, a first discharge path 83, and a second discharge path 84 as conveying paths for conveying sheets. Furthermore, the sheet processing apparatus 4 includes, as discharge destinations for discharging sheets, an upper discharge tray 25 and a lower discharge tray 37 each protruding outward from an apparatus main body 4A (a housing in which the receiving path 81, the internal discharge path 82, the first discharge path 83, and the second discharge path 84 are provided) to the outside of the apparatus main body 4A. The receiving path 81 is a conveying path for receiving a sheet from the image forming apparatus 1 and conveying the sheet, and the internal discharge path 82 is a conveying path for conveying a sheet toward the sheet processing device 71. The first discharge path 83 is a conveying path for discharging a sheet to the upper discharge tray 25, and the second discharge path 84 is a conveying path for discharging a sheet to the lower discharge tray 37. As described above, according to the present embodiment, the receiving path 81 and the first discharge path 83 form a first conveying path toward the upper discharge tray 25 serving as a first stacking member, and the internal discharge path 82 is provided as a second conveying path that branches from the first conveying path. In addition, the second discharge path 84 is provided as a third conveying path extending from the sheet processing device 71 toward the lower discharge tray 37 serving as a second stacking member.

The receiving path 81 has, disposed therein, inlet rollers 21, pre-branch rollers 22, and an inlet sensor 27. The first discharge path 83 has, disposed therein, discharge and reverse rollers 24 as a reversal conveying unit. The internal discharge path 82 has, disposed therein, internal discharge rollers 26, intermediate conveying rollers 28, kickout rollers 29, and a pre-intermediate stacking sensor 38. The second discharge path 84 has bundle discharge rollers 36 disposed therein. The pre-branch rollers 22 serve as a first conveying device of the present embodiment, the discharge and reverse rollers 24 serve as a second conveying device of the present embodiment, and the internal discharge rollers 26 serve as a third conveying device of the present embodiment. Each of the inlet rollers 21, the pre-branch rollers 22, the discharge and reverse rollers 24, the internal discharge rollers 26, the intermediate conveying rollers 28, the kickout rollers 29, and the bundle discharge rollers 36 is a roller pair in which the rollers are in contact with each other at the circumferential surface to form a nip that nips and conveys a sheet. The discharge and reverse rollers 24 also serve as a discharge device for discharging a sheet.

Both the inlet sensor 27 and the pre-intermediate stacking sensor 38 are examples of a sheet detection unit for detecting the passage of a sheet at a predetermined detection position in the conveying path in the sheet processing device. As the inlet sensor 27 and the pre-intermediate stacking sensor 38, a reflective photosensor, for example, is used that emits infrared light to the inside of the conveying path and detects the light reflected by the sheet passing through the conveying path to determine the presence of the sheet.

The sheet conveying path in the sheet processing apparatus 4 is described below. A sheet conveyed from the image forming apparatus 1 via the relay unit 14 is received by the inlet rollers 21 of the sheet processing apparatus 4 and is conveyed to the pre-branch rollers 22 through the receiving path 81. The inlet sensor 27 detects the sheet at a detection position between the inlet rollers 21 and the pre-branch rollers 22.

The pre-branch rollers 22 conveys the sheet received from the inlet rollers 21 toward the first discharge path 83.

At a predetermined time point after the inlet sensor 27 detects the passage of the trailing edge of the sheet, the pre-branch rollers 22 accelerate the sheet conveying speed to a speed higher than that of the relay unit 14. Alternatively, the sheet conveying speed of the inlet rollers 21 may be set higher than that of the relay unit 14, and the sheet conveying speed may be accelerated by the inlet rollers 21 upstream of the pre-branch rollers 22. In this case, it is desirable to install a one-way clutch between the conveying roller of the relay unit 14 and a motor that drives the conveying roller so that the conveying roller runs idle even if the sheet is pulled by the inlet rollers 21.

When the sheet discharge destination is the upper discharge tray 25, the discharge and reverse rollers 24 discharge the sheet received from the pre-branch rollers 22 to the upper discharge tray 25. In this case, the discharge and reverse rollers 24 decelerate the discharge speed to a predetermined discharge speed at a predetermined time point after the trailing edge of the sheet moves past the pre-branch rollers 22.

When the sheet discharge destination is the lower discharge tray 37, the discharge and reverse rollers 24 performs switchback conveyance of the sheet received from the pre-branch rollers 22 to convey the sheet to the internal discharge path 82.

That is, the discharge and reverse rollers 24 convey the sheet toward the outside of the sheet processing apparatus 4 in the discharge direction and reverse their rotation directions to convey the sheet in the opposite direction before the trailing edge of the sheet in the discharge direction moves past the discharging and reversing rollers 24. A check valve 23 is provided at a branching portion (between the pre-branch rollers 22 and the discharge and reverse rollers 24) where the internal discharge path 82 branches from both the receiving path 81 and the first discharge path 83 upstream of the discharge and reverse rollers 24 in the discharge direction. The check valve 23 functions as a guide (a restricting member) that restricts the backward movement of the sheet switched back by the discharge and reverse rollers 24 to the receiving path 81. That is, the discharge and reverse rollers 24 reverse the conveying direction of the sheet after the trailing edge of the sheet in the discharge direction moves past the check valve 23 to perform switchback conveyance.

The internal discharge rollers 26, the intermediate conveying rollers 28, and the kickout rollers 29 disposed in the internal discharge path 82 sequentially pass the sheet received from the discharge and reverse rollers 24 to the next rollers to convey the sheet toward the sheet processing device 71. The pre-intermediate stacking sensor 38 detects the sheet positioned between the intermediate conveying rollers 28 and the kickout rollers 29. The pre-intermediate stacking sensor 38 is, for example, a reflective photosensor that emits infrared light to the inside of the conveying path and detects the light reflected by the sheet passing through the conveying path to determine the presence of the sheet.

The sheet processing apparatus 4 includes a superposition processing unit 4B including the discharge and reverse rollers 24 and the internal discharge rollers 26 and can perform an operation to superpose a plurality of sheets conveyed from the image forming apparatus 1 one on top of another by using the superposition processing unit 4B. According to the present embodiment, the superposition processing unit 4B holds, in the internal discharge path 82, a first sheet conveyed through the receiving path 81 by using the discharge and reverse rollers 24 and the internal discharge rollers 26. Subsequently, the superposition processing unit 4B superposes a second sheet conveyed through the receiving path 81 on the first sheet. The superposition processing unit 4B also has a function of outputting the superposed sheets onto the upper discharge tray 25 (superposed discharge) and a function of conveying the superposed sheets to the sheet processing device 71 (a buffer function). The configuration and operation of the superposition processing unit 4B are described in detail below.

After aligning the plurality of sheets received from the internal discharge path 82, the sheet processing device 71 performs a binding process at a predetermined position of the sheet bundle. The sheet processing device 71 includes a stapler 50 as processing equipment and an upper intermediate stacking guide 31 and a lower intermediate stacking guide 32 that constitute an intermediate stacking member (a processing tray) on which sheets to be processed are stacked.

A vertical alignment reference plate 39 serving as a reference member is disposed at the downstream end of the sheet processing device 71 in the conveying direction of the kickout roller 29. The position of the sheet bundle in the vertical direction (the conveying direction) is aligned by bringing the edges of the sheets in the conveying direction into contact with the vertical alignment reference plate 39. A half-moon roller 33 rotatably supported by the upper intermediate stacking guide 31 is provided downstream of the pressing guide 56.

The half-moon roller 33 is a moving member (a paddle member, a conveying member) for bringing the sheet that has passed through the kickout rollers 29 into contact with the vertical alignment reference plate 39. After the trailing edge of the sheet moves past the pre-intermediate stacking sensor 38, the half-moon roller 33 conveys the sheet toward the vertical alignment reference plate 39 at a predetermined time point. The contact pressure of the half-moon roller 33 against the sheet is adjusted to such an extent that the half-moon roller 33 slips on the sheet when the sheet is in contact with the vertical alignment reference plate 39. A flexible pressing guide 56 is fixed to the upper intermediate stacking guide 31 and presses the sheet in the sheet processing device 71 downward with a predetermined pressure to prevent the sheet from lifting. Furthermore, a bundle pressing flag 30 is rotatably supported downstream of the kickout rollers 29 to prevent the trailing edge of the sheet from lifting so that the trailing edge of the sheet already stacked in the sheet processing device 71 does not interfere with the leading edge of the succeeding sheet discharged by the kickout rollers 29.

When the alignment of a predetermined number of sheets on the intermediate stacking member is finished, the stapler 50 performs a binding operation. Then, the bundle discharge guide 34 serving as an extrusion member driven by a guide drive unit 35 moves in a direction from the standby position illustrated in FIG. 1 toward the bundle discharge rollers 36 (a bundle discharge direction). Thus, the sheet bundle is pushed out of the intermediate stacking member. When the leading edge of the sheet bundle in the bundle discharge direction reaches the bundle discharge rollers 36, the bundle discharge guide 34 stops and returns to the standby position again. The bundle discharge rollers 36 serving as a discharge device (a fourth conveying device) discharges the sheet bundle received from the bundle discharge guide 34 to the lower discharge tray 37.

Both the upper discharge tray 25 and the lower discharge tray 37 are movable vertically relative to the housing of the sheet processing apparatus 4. Sheet presence sensors 51 and 53 for detecting the presence/absence of a sheet on a tray are disposed on the upper discharge tray 25 and the lower discharge tray 37, respectively. The sheet presence sensors 51 and 53 are, for example, reflective photosensors that determine the presence/absence of a sheet by emitting infrared light upward from the tray stacking surface and detecting reflected light from the sheets. The sheet processing apparatus 4 further includes a sheet surface detection sensor that detects the upper surface position of the sheets (the sheet stack height) on each of the upper discharge tray 25 and the lower discharge tray 37.

When the sheet surface detection sensor detects a sheet, the corresponding one of the upper discharge tray 25 and the lower discharge tray 37 tray is lowered in an A2 or B2 direction. When the sheet presence sensor 51 or 53 detects that the sheet has been removed from the upper discharge tray 25 or the lower discharge tray 37, the tray is raised in the A1 or B1 direction. The upper discharge tray 25 and the lower discharge tray 37 are controlled to move up and down according to the number of stacked sheets so that the upper surfaces of the stacked sheets are positioned below the discharge and reverse rollers 24 and the bundle discharge rollers 36 in the vertical direction, respectively. According to the present embodiment, the upper discharge tray 25 serving as the first stacking member and the lower discharge tray 37 serving as the second stacking member are controlled to be raised and lowered by motor drive. However, the upper discharge tray 25 and the lower discharge tray 37 may be configured so as to be raised and lowered by an urging unit, such as a spring.

The stapler 50 is an example of the processing equipment. For example, a sorting mechanism for sorting sheets and a center-folding processing unit for center folding a plurality of sheets and perform saddle stitch book binding may be provided.

Superposition Processing Unit

Figure 2:
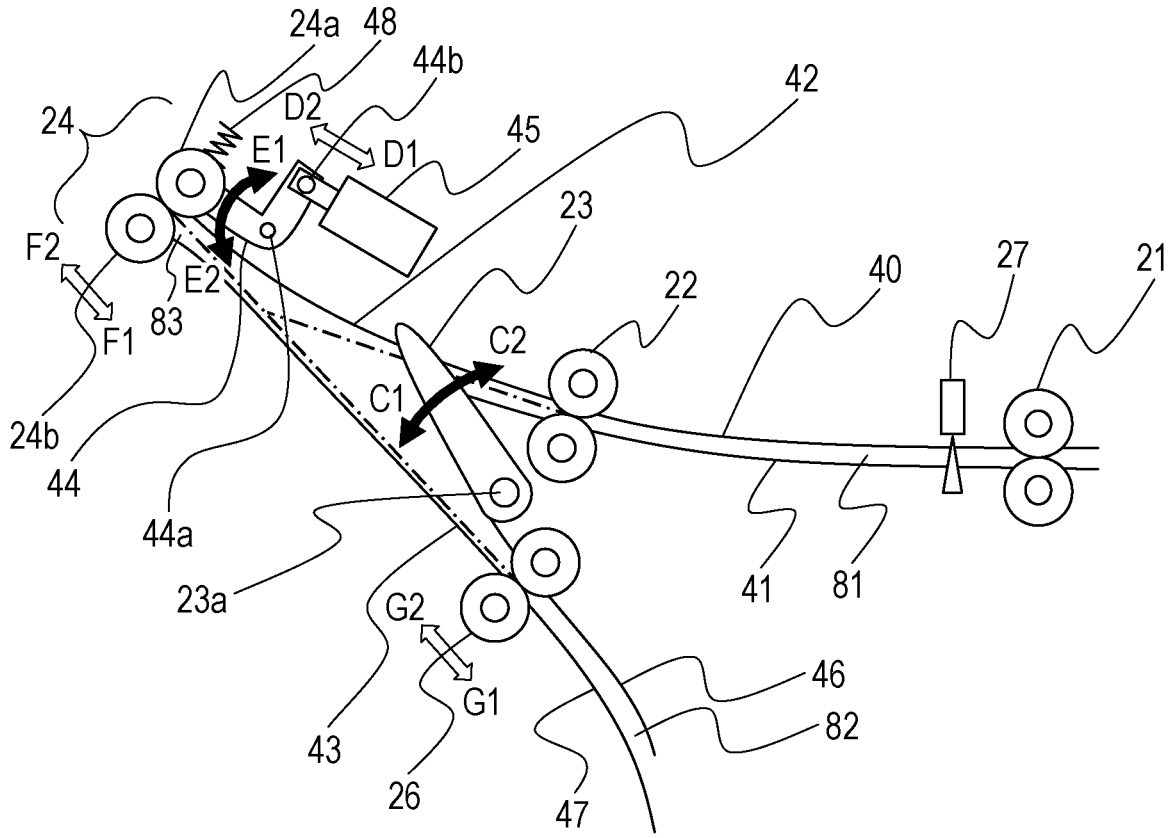
FIG. 2 is a cross-sectional view of a superposition processing unit according to an embodiment.

FIG. 2 is an enlarged view of the superposition processing unit 4B. The sheet conveying path between the inlet rollers 21 and the pre-branch rollers 22 (the receiving path 81) consists of an upper inlet guide 40 and a lower inlet guide 41. The sheet conveying path between the internal discharge rollers 26 and the intermediate conveying rollers 28 (the internal discharge path 82) consists of an upper internal discharge guide 46 and a lower internal discharge guide 47. A conveying guide that guides a sheet from the same side as the upper inlet guide 40 between the pre-branch rollers 22 and the discharge and reverse rollers 24 is referred to as an upper reverse guide 42. A conveying guide that guides a sheet from the same side as the lower internal discharge guide 47 between the discharge and reverse rollers 24 and the internal discharge rollers 26 is referred to as a lower reverse guide 43. The first discharge path 83 consists of the upper reverse guide 42 and the lower reverse guide 43.

The sheet conveyed by the inlet rollers 21 is guided to the pre-branch rollers 22 by the upper inlet guide 40 and the lower inlet guide 41. The inlet sensor 27 is disposed on the upper inlet guide 40. As the inlet sensor 27, a reflective photosensor can be used that determines the presence of a sheet at the detection position by emitting infrared light to the receiving path 81 and detecting reflected light from the sheet. In this case, a hole having a diameter greater than the diameter of the spotlight of the inlet sensor 27 is formed in a portion of the lower inlet guide 41 facing the inlet sensor 27 so that the infrared light is not reflected when a sheet does not pass through the receiving path 81.

The check valve 23 is disposed downstream of the pre-branch rollers 22 and at a portion where the receiving path 81 and the internal discharge path 82 branch from the first discharge path 83. The check valve 23 is rotatably supported by the upper internal discharge guide 46 via a rotating shaft 23*a*. In addition, the check valve 23 is always urged by a spring (not illustrated) in a C2 direction (the clockwise direction in FIG. 2) toward a position (refer to FIG. 2) where the top end of the check valve 23 overlaps the upper reverse guide 42 as viewed from the axial direction of the rotating shaft 23*a* (the width direction of a sheet). The spring constant of the spring is set to such a value that when a sheet delivered from the pre-branch rollers 22 is brought into contact with the check valve 23, the check valve 23 rotates in the C1 direction (the counterclockwise direction in FIG. 2) against the biasing force of the spring. Thus, the check valve 23 enables the sheet conveyed from the pre-branch rollers 22 toward the discharge and reverse rollers 24 to pass therethrough. In addition, when the trailing edge of the sheet in the receiving path 81 passes through the check valve 23, the check valve 23 rotates in the C2 direction and restricts the sheet from returning from the discharge and reverse rollers 24 to the pre-branch rollers 22.

The discharge and reverse rollers 24 consist of an upper roller 24*a* and a lower roller 24*b*. According to the present embodiment, driving force is input to both the upper roller 24*a* and the lower roller 24*b*, and the rotations of the upper roller 24*a* and the lower roller 24*b* are always synchronized.

The discharge and reverse rollers 24 are configured to contact each other (a close operation) and separate from each other (an open operation) by a plunger solenoid 45. More specifically, one end of a separation lever 44 is connected to the roller shaft of the upper roller 24*a*, and the separation lever 44 is supported by a lever fulcrum shaft 44*a* in a rotatable manner with respect to the upper reverse guide 42. A solenoid connection shaft 44*b* provided at the other end of the separation lever 44 is connected to a plunger of the plunger solenoid 45.

When the plunger solenoid 45 is powered on, the plunger is attracted in a D1 direction by a magnetic force. Thus, the separation lever 44 rotates in an E1 direction, and the discharge and reverse rollers 24 are separated from each other (the nip of the roller pair is released). When the plunger solenoid 45 is powered off, the upper roller 24*a* is brought into contact with the lower roller 24*b* by the biasing force of a pressure spring 48 connected to the roller shaft of the upper roller 24*a*, and the discharge and reverse rollers 24 are in contact with each other (the nip is closed). At this time, the separation lever 44 rotates in the E2 direction as the upper roller 24*a* moves, and the plunger of the plunger solenoid 45 moves in the D2 direction.

The internal discharge rollers 26 form a roller pair adjacent to the discharge and reverse rollers 24 in the sheet conveying direction in the internal discharge path 82. The roller pair is capable of forward rotation and reverse rotation. That is, the internal discharge rollers 26 can convey a sheet in both the direction from the discharge and reverse rollers 24 to the sheet processing device 71 (hereinafter referred to as a G1 direction) and the direction from the sheet processing device 71 to the discharge and reverse rollers 24 (hereinafter referred to as a G2 direction).

Hardware Configuration

Figure 3:
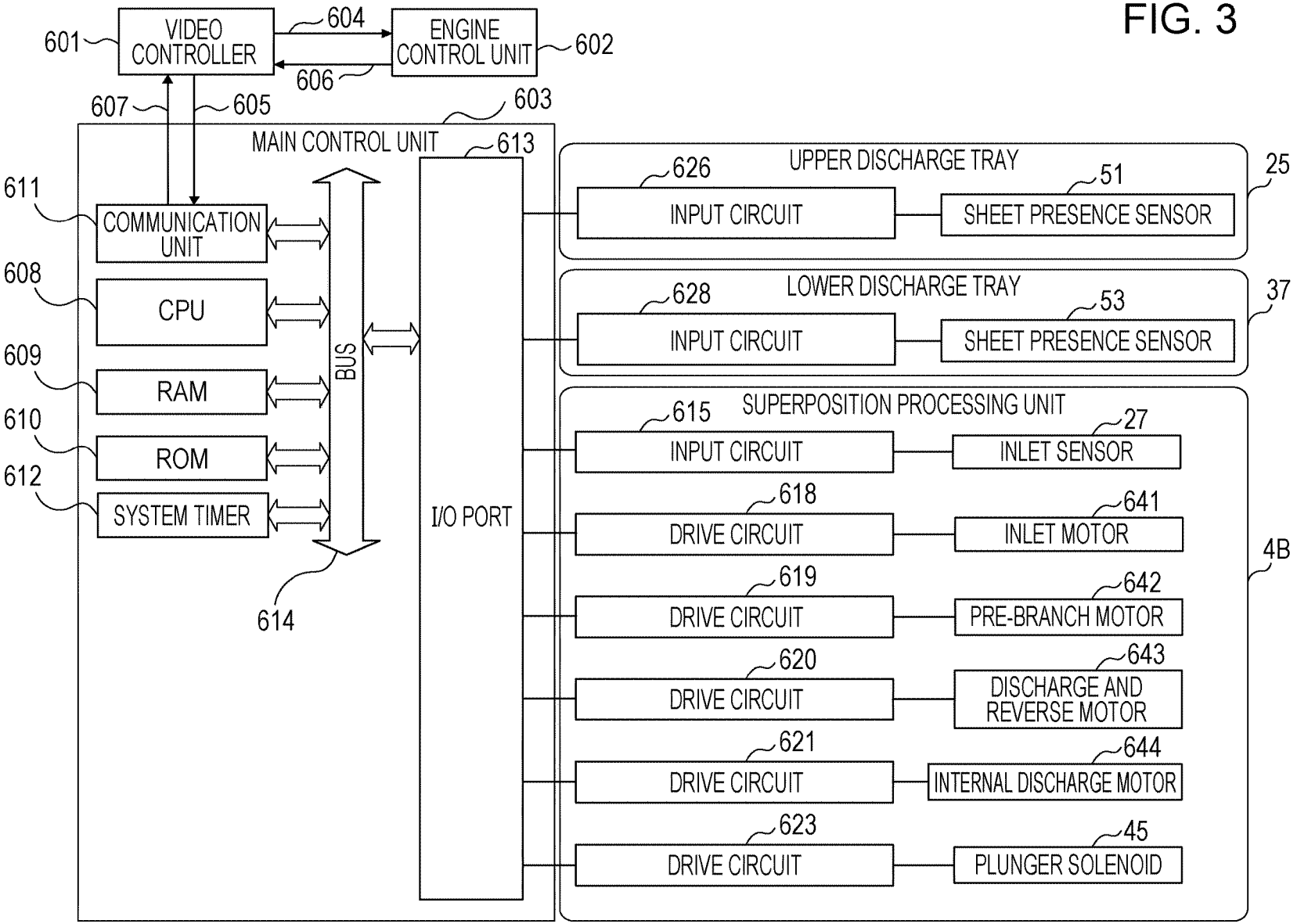
FIG. 3 is a hardware configuration diagram of the image forming system according to the embodiment.

The hardware configuration of the image forming system 1S according to the present embodiment is described below with reference to FIG. 3. FIG. 3 mainly illustrates, of the hardware configuration of the image forming system 1S, a portion related to the configuration of the sheet processing apparatus 4. A video controller 601 performs overall control of the image forming system 1S including the image forming apparatus 1 and the sheet processing apparatus 4. An engine control unit 602 controls the image forming apparatus 1.

A main control unit 603 controls the sheet processing apparatus 4. A signal line 604 is a signal line for serial command transmission to transmit a command from the video controller 601 to the engine control unit 602 by serial communication, and a signal line 605 is similarly used to transmit a command from the video controller 601 to the main control unit 603. A signal line 606 is a signal line for serial status transmission to transmit status data from the engine control unit 602 to the video controller 601 by serial communication in response to a command, and a signal line 607 is similarly used to transmit status data from the main control unit 603 to the video controller 601. To perform an image forming operation, the video controller 601 transmits serial commands to the engine control unit 602 and the main control unit 603 and receives status data from the engine control unit 602 and the main control unit 603. Thus, the video controller 601 performs control. In this way, when a plurality of apparatuses are connected and the image forming system 1S operates, the video controller 601 manages the control and status of each of the apparatuses and ensures the consistency of the operations performed by the apparatuses.

The main control unit 603 includes a central processing unit (CPU) 608 that controls various operations performed by the sheet processing apparatus 4 and a random access memory (RAM) 609 that temporarily stores control data necessary for the operations performed by the sheet processing apparatus 4.

The main control unit 603 further includes a nonvolatile read only memory (ROM) 610 that stores programs and control tables necessary for the operation performed by the sheet processing apparatus 4. The main control unit 603 further includes a communication unit 611 for communicating with the video controller 601, a system timer 612 that generates timings necessary for various controls, and an input and output (I/O) port 613 that inputs and outputs control signals from and to various units of the sheet processing apparatus 4. The main control unit 603 is a control integrated circuit (IC) to which the above-described elements are connected via a bus 614.

Input signals from the inlet sensor 27 and the sheet presence sensors 51 and 53 of the upper discharge tray 25 and the lower discharge tray 37 are transmitted to the main control unit 603 via input circuits 615, 626, and 628, respectively. The control signals from the main control unit 603 are transmitted to an inlet motor 641, a pre-branch motor 642, a discharge and reverse motor 643, an internal discharge motor 644, and the plunger solenoid 45 via drive circuits 618, 619, 620, 621, and 623, respectively. Thus, the driving of actuators is controlled.

Functional Block

Figure 4:
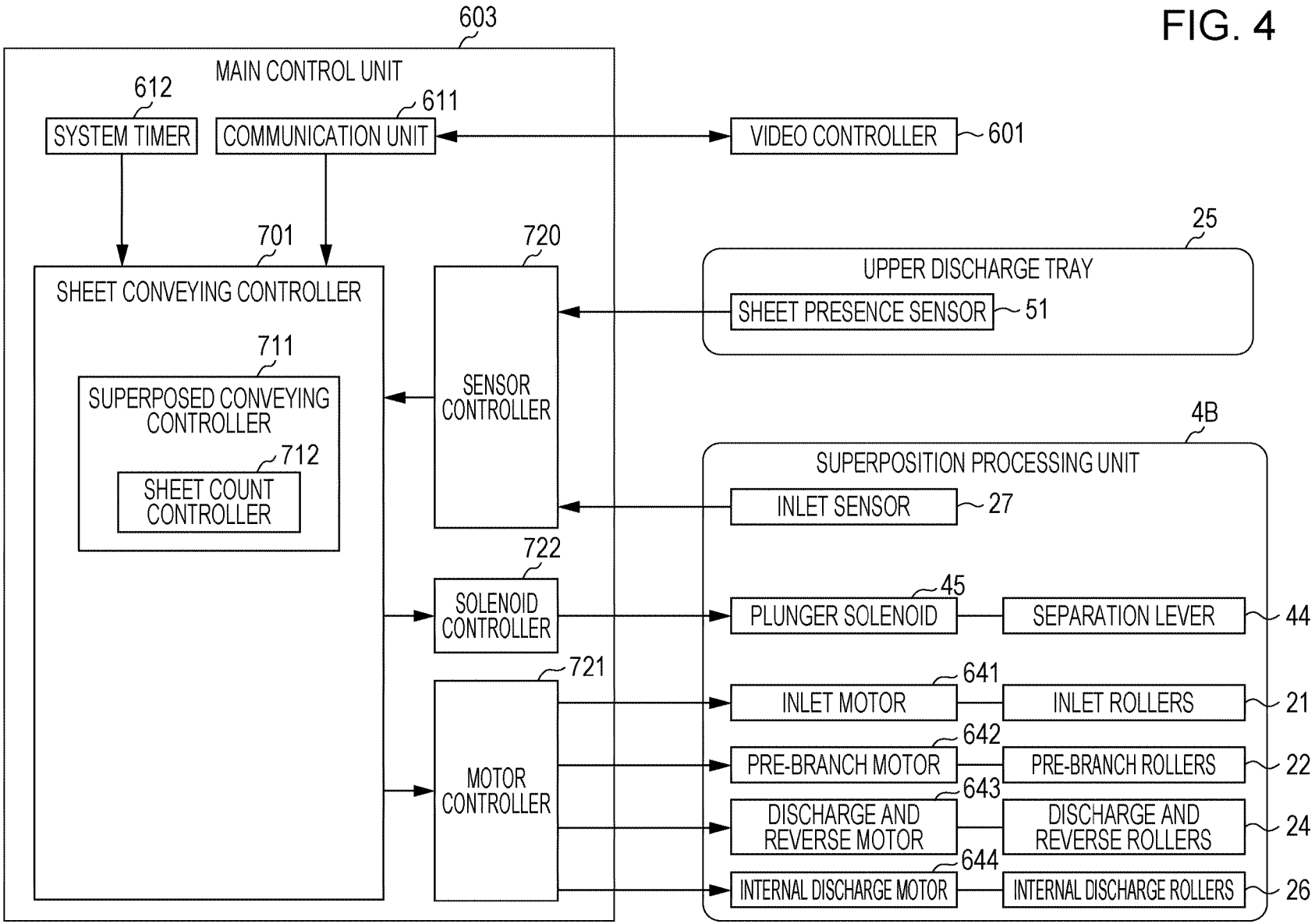
FIG. 4 is a functional block diagram of the image forming system according to the embodiment.

The functional blocks of the present embodiment are described below with reference to FIG. 4. The main control unit 603 illustrated in FIG. 4 has a function of performing a sheet conveying operation by using the sheet processing apparatus 4. The main control unit 603 has at least the functions of the communication unit 611, a system timer 612, a sheet conveying controller 701, a sensor controller 720, a motor controller 721, and a solenoid controller 722.

The sensor controller 720 is a unit for inputting signals from the inlet sensor 27 and the sheet presence sensor 51 of the upper discharge tray 25 to the sheet conveying controller 701. The sheet conveying controller 701 includes a superposed conveying controller 711 and a sheet count controller 712. The sheet conveying controller 701 controls the motor controller 721 and the solenoid controller 722 on the basis of the input from the sensor controller 720 to achieve the operations performed by the superposition processing unit 4B, the upper discharge tray 25, and the lower discharge tray 37. The superposed conveying controller 711 controls conveyance of a sheet to the superposition processing unit 4B and the upper discharge tray 25 while managing the position of the sheet on the basis of mainly the input from the sensor controller 720. The sheet count controller 712 determines the timing of discharging the superposed sheets to the upper discharge tray 25 on the basis of the maximum number of sheets that can be superposed by the superposition processing unit 4B (the number of superposable sheets) and the current number of superposed sheets.

The inlet motor 641 drives the inlet rollers 21, the pre-branch motor 642 drives the pre-branch rollers 22, and the discharge and reverse motor 643 drives the discharge and reverse rollers 24. The internal discharge motor 644 drives the internal discharge rollers 26, and the plunger solenoid 45 drives the separation lever 44. The operations performed by these elements to be driven are described in detail below.

Superposed Discharge Operation

An overview of a bundle discharge operation (a superposed discharge operation) in which the superposed conveying controller 711 superposes and discharges a plurality of sheets by the superposition processing unit 4B is described with reference to FIGS. 5A to 5G. Hereinafter, among the sheets to be subjected to the superposed discharge operation, a sheet conveyed from the image forming apparatus 1 to the sheet processing apparatus 4 first (a first sheet) is referred to as a "sheet S1", and a sheet conveyed from the image forming apparatus 1 to the sheet processing apparatus 4 second (a second sheet) is referred to as a "sheet S2". In addition, the conveying speed of the pre-branch rollers 22, the discharge and reverse rollers 24, and the internal discharge rollers 26 before acceleration (the conveying speed in the relay unit 14) is defined as V1, and the conveying speed after acceleration is defined as V2. The conveying speed when a sheet is discharged by the discharge and reverse rollers 24 is defined as V3. According to the present embodiment, the conveying speed V3 can be changed according to the number of sheets in the bundle.

Figure 5A:
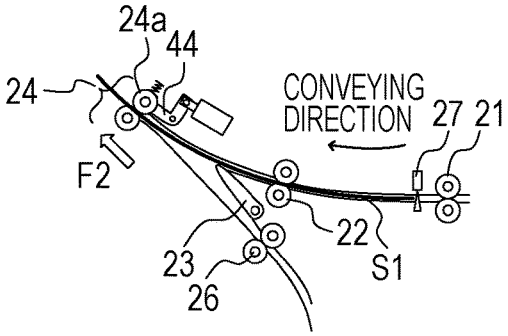
FIGS. 5A to 5G illustrate the operation performed by the superposition processing unit according to the embodiment.

Referring to FIG. 5A, at the time the trailing edge of the preceding sheet S1 passes the inlet sensor 27, the pre-branch rollers 22 and the discharge and reverse rollers 24 are accelerated from the speed V1 to the speed V2. By accelerating the conveying speed of the sheet S1, even in the case where the image forming apparatus 1 is a high-performance machine with high throughput, the sheet interval required for switchback can be ensured between the sheet S1 and the succeeding sheet S2. However, if the sheets S1 and S2 do not collide with each other, a configuration in which the conveying speed at the inlet sensor 27 is not accelerated may be employed. In this case, the conveying speed in the superposition processing unit 4B may be set to V1 at all times. At the time in FIG. 5A, the discharge and reverse rollers 24 are conveying the sheet S1 in an F2 direction.

Figure 5B:
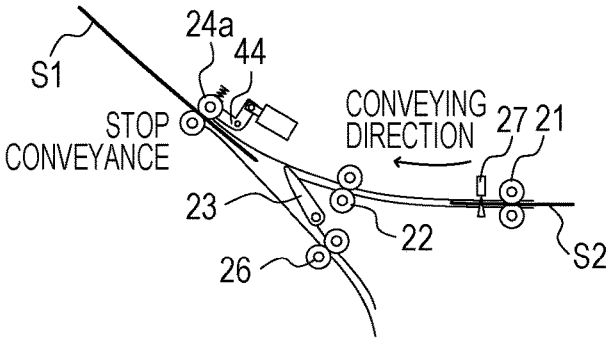

Referring to FIG. 5B, at the time the trailing edge of the sheet S1 passes the inlet sensor 27, moves a predetermined distance, and passes through the check valve 23, the sheet S1 is temporarily stopped. The "predetermined distance" is the distance at which the trailing edge of the sheet S1 in the F2 direction has passed through the check valve 23 and does not reach the nip of the discharge and reverse rollers 24.

Figure 5C:
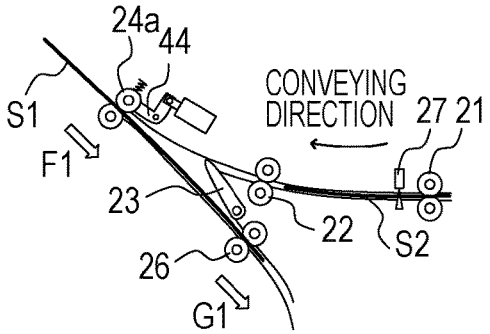

Referring to FIG. 5C, the discharge and reverse rollers 24 change their rotation directions and convey the sheet S1 in an F1 direction at the speed V2. The driving of the internal discharge rollers 26 is started before the leading edge of the sheet S1 in the F1 direction reaches the internal discharge rollers 26, and the internal discharge rollers 26 further convey the sheet S1 in the G1 direction.

Figure 5D:
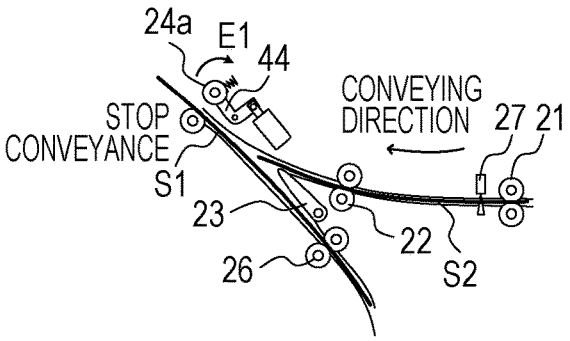

Referring to FIG. 5D, the sheet S1 is nipped by the internal discharge rollers 26. When the leading edge of the sheet S1 in the G1 direction (the F1 direction) moves past the internal discharge rollers 26 and, thereafter, the sheet S1 is conveyed by a predetermined distance, the conveyance of the sheet S1 is stopped. The "predetermined distance" is less than the distance at which the leading edge of the sheet S1 reaches the intermediate conveying rollers 28. When the sheet S1 is nipped by the internal discharge rollers 26, the upper roller 24*a* of the discharge and reverse rollers 24 is moved in the E1 direction by the separation lever 44 so as to be separated from the lower roller 24*b*. Note that the discharge and reverse rollers 24 are driven so as to separate from each other before the leading edge of the succeeding sheet S2 reaches the discharge and reverse rollers 24.

Figure 5E:
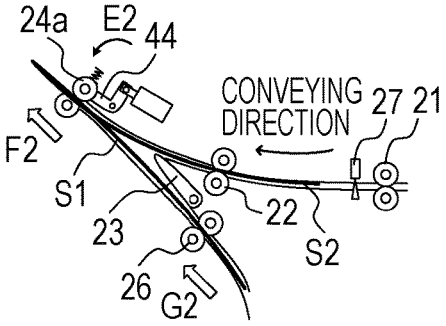

Referring to FIG. 5E, after the trailing edge of the succeeding sheet S2 passes the inlet sensor 27, the pre-branch rollers 22 and the discharge and reverse rollers 24 are accelerated to the speed V2 in the same manner as the preceding sheet S1. When the trailing edge of the sheet S2 passes the inlet sensor 27 and, thereafter, a predetermined time T_wait elapses, the internal discharge rollers 26 start rotating again toward the discharge and reverse rollers 24, and the sheet S1 is conveyed in the G2 direction. The predetermined time T_wait is described in more detail below. When the relative speeds of the sheets S1 and S2 become equal, the upper roller 24*a* of the discharge and reverse rollers 24 is driven in the E2 direction and comes into contact with the lower roller 24*b*, and the discharge and reverse rollers 24 nip the sheets S1 and S2 at the same time. At this time, the leading edge of the sheet S1 and the leading edge of the sheet S2 in the F2 direction are aligned. In addition, before the discharging and reversing rollers 24 nip the sheets S1 and S2, the rotation speed of the discharge and reverse rollers 24 is adjusted so as to be equal to the speed V2, which is the conveying speed of the sheets S1 and S2.

Figure 5F:
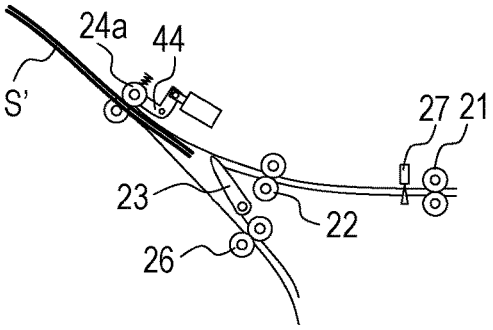

Referring to FIG. 5F, when the trailing edge of the sheet S2 passes through the check valve 23, the sheets S1 and S2 form a sheet bundle S' in which both the leading edges and trailing edges of the sheets S1 and S2 in the F2 direction are aligned.

Figure 5G:
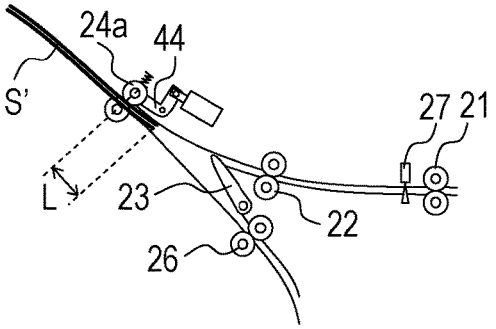

Referring to FIG. 5G, the speed of the sheet bundle S' is changed to the speed V3 before a distance L from the discharge and reverse rollers 24, and the sheet bundle S' is discharged to the upper discharge tray 25 by the discharge and reverse rollers 24.

Thus, the operation of superposing and discharging the two sheets S1 and S2 while aligning the two sheets S1 and S2 in the superposition processing unit 4B (the superposed discharge operation) is completed. When the image forming operation is continuously performed on a large number of sheets, two-sheet bundles are stacked on the upper discharge tray 25 by repeating the above-described superposed discharge operation.

Advantages of the present embodiment are described below, compared with the case where the sheets S1 and S2 are discharged one by one without being subjected to the superposed discharge operation. When the sheets S1 and S2 are discharged one by one, the positions and postures of the sheets S1 and S2 that have passed through the discharge and reverse rollers 24 may be lost before the sheets S1 and S2 land on the upper surface of the upper discharge tray 25 or the upper surface of the sheets on the upper discharge tray 25. This is because while falling down, each of the sheets S1 and S2 receives air resistance and, thus, moves in all directions as viewed from above.

In contrast, according to the present embodiment, the positions of the sheets S1 and S2 are aligned in the sheet conveyance direction and the sheets S1 and S2 are superposed in advance and are discharged, so that the positions and postures of the sheets S1 and S2 are less likely to be lost. When the sheet bundle discharged through the superposed discharge operation is compared with the sheets discharged one by one, the projected areas of the sheet (bundle) and the single sheet as viewed from above are the same, but the weight of the sheet bundle is two times the weight of the single sheet. For this reason, the sheet bundle is less susceptible to air resistance. As a result, even when the sheet discharge speed of the discharge and reverse rollers 24 is increased to improve the productivity of the image forming system 1S and the productivity of the sheet processing apparatus 4, a degradation of the sheet stackability can be avoided.

Three or More Sheet Superposed Discharge Operation

While the above description has been made with reference to the conveyance of two sheets, the sheet processing apparatus 4 of the present embodiment can perform a superposed discharge operation to align the positions of three or more sheets, superpose the sheets on top of another in the superposition processing unit 4B, and discharge the sheets to the upper discharge tray 25.

When the superposed discharge operation is performed for three sheets, two sheets S1 and S2 are first superposed in the same procedure as described above with reference to FIGS. 5A to 5F. Thereafter, the discharge and reverse rollers 24 illustrated in FIG. 5F are reversed again so that the sheet bundle S' is conveyed in the G1 direction. Subsequently, a third sheet S3 is subjected to operations the same as those performed on the sheet S2 in FIGS. 5C to 5F while the sheet bundle S' is being subjected to operations the same as those performed on the sheet S1 in FIGS. 5C to 5F.

As a result, after the sheet bundle S' is temporarily stopped while being held by the internal discharge rollers 26 in the internal discharge path 82, when the predetermined time T_wait elapses since the inlet sensor 27 detected the trailing edge of the third sheet S3, the internal discharge rollers 26 convey the sheet bundle S' in the G2 direction. Thereafter, the discharge and reverse rollers 24 that have been open is closed, so that the three sheets S1, S2, and S3 are nipped by the discharge and reverse rollers 24 at the same time. When the trailing edge of the sheet S3 passes through the check valve 23, a sheet bundle is formed in which both the leading edges and the trailing edges of the three sheets S1, S2, and S3 are aligned.

When the number of sheets in the superposed discharge operation is three, the sheet bundle is directly discharged in the G2 direction by the discharge and reverse rollers 24 and is stacked on the upper discharge tray 25. When the number of sheets in the superposed discharge operation is four or more, the discharge and reverse rollers 24 convey the sheet bundle again in the G1 direction and repeats the same operations as in FIGS. 5C to 5F. In this manner, the number of sheets to be superposed can be increased.

The sheet count controller 712 manages the number of sheets to be superposed in the superposition processing unit 4B on the basis of the number of sheets superposable by the superposition processing unit 4B and information regarding the sheet to be conveyed. That is, the sheet count controller 712 determines whether the sheet conveyed to the superposition processing unit 4B is immediately discharged to the upper discharge tray 25 or is superposed on top of another.

As an example of the determination technique, let N denote the number of superposable sheets by the superposition processing unit 4B. Then, the sheet count controller 712 generates a sheet bundle of N−1 sheets and discharges the sheet bundle to the upper discharge tray 25. Only when the sheet count controller 712 determines that the Nth sheet is the last sheet, the number of sheets to be superposed is set to N. In this way, the sheet count controller 712 prevents discharge of the Nth sheet to the upper discharge tray 25 as one sheet.

As a specific example, the number of superposable sheets by the superposition processing unit 4B is five in the configuration example according to the present embodiment. In this case, the sheet count controller 712 repeatedly performs the superposed discharge operation for four sheets and stacks a sheet bundle of the four sheets on the upper discharge tray 25. At this time, if the sheet count controller 712 determines that the fifth sheet is the last sheet and the last sheet is discharged as one sheet if the superposed discharge operation for four sheets is repeated to the end, a superposed discharge operation for five sheets including the last sheet is performed, and the sheets are discharged to the upper discharge tray 25. If the last sheet is superposed on another sheet even after the superposed discharge operation for four sheets is performed to the end, the sheet bundle is discharged to the upper discharge tray 25 when the sheet bundle including the last sheet is formed.

That is, when executing a job of discharging a predetermined number of sheets to the upper discharge tray 25, the sheet count controller 712 changes the number of sheets in a bundle formed through the superposed discharge operation in accordance with a predetermined number of sheets so that each of the predetermined number of sheets is always included in a sheet bundle of two or more sheets formed through the superposed discharge operation and is discharged to the upper discharge tray 25. As a result, it is possible to prevent a single sheet from being discharged to the upper discharge tray 25 and, thus, prevent a degradation of the sheet stackability. Note that the technique for controlling the number of sheets in the superposed discharge operation is not limited thereto. Any technique that avoids discharge of a single sheet can be employed. For example, in the above-described example, the number of sheets in the successive superposed discharge operations may be four, . . . , four, three, and two.

Way to Find T_wait

The timing management (a method for obtaining T_wait described above) is described that is performed by the superposed conveyance controller 711 to align the leading edges of the sheets S1 and S2 in the superposition processing unit 4B.

Figure 7A:
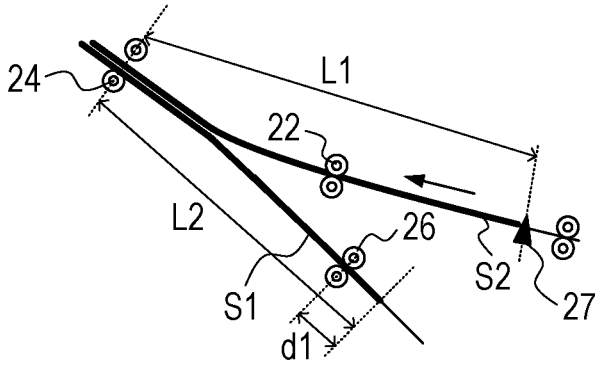
FIGS. 7A to 7C illustrate a method for controlling a protrusion amount between sheets by using the superposition processing unit according to the embodiment.

FIG. 7A illustrates the positional relationship between the sheets S1 and S2 at the moment the inlet sensor 27 detects the trailing edge of the sheet S2. A distance L1 is the distance from the detection position of the inlet sensor 27 to the nip position of the discharge and reverse rollers 24 (the length measured along the receiving path 81 and the first discharge path 83). A distance L2 is the distance from the position where after passing the internal discharge rollers 26, the leading edge of the reversed sheet S2 moves a predetermined distance d1 and stops to the nip of the discharge and reverse rollers 24 (the length measured along the first discharge path 83 and the internal discharge path 82).

Figure 7B:
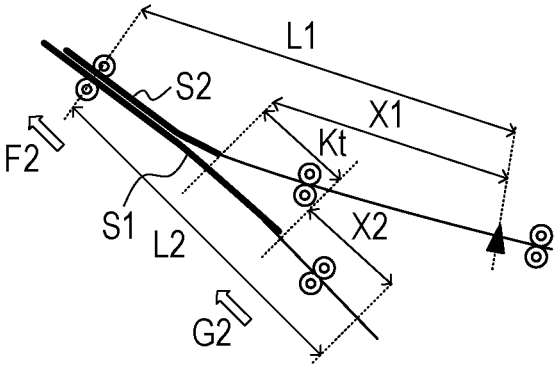

FIG. 7B illustrates the positional relationship between the sheets S1 and S2 when conveyance of the sheet S1 in FIG. 7A is started in the F2 direction (the G2 direction) and the conveying speed of the sheet S1 becomes equal to the conveying speed of the sheet S2. At this time, it is assumed that the trailing edges of the sheets S1 and S2 in the F2 direction are shifted from each other by a protrusion amount Kt.

Figure 7C:
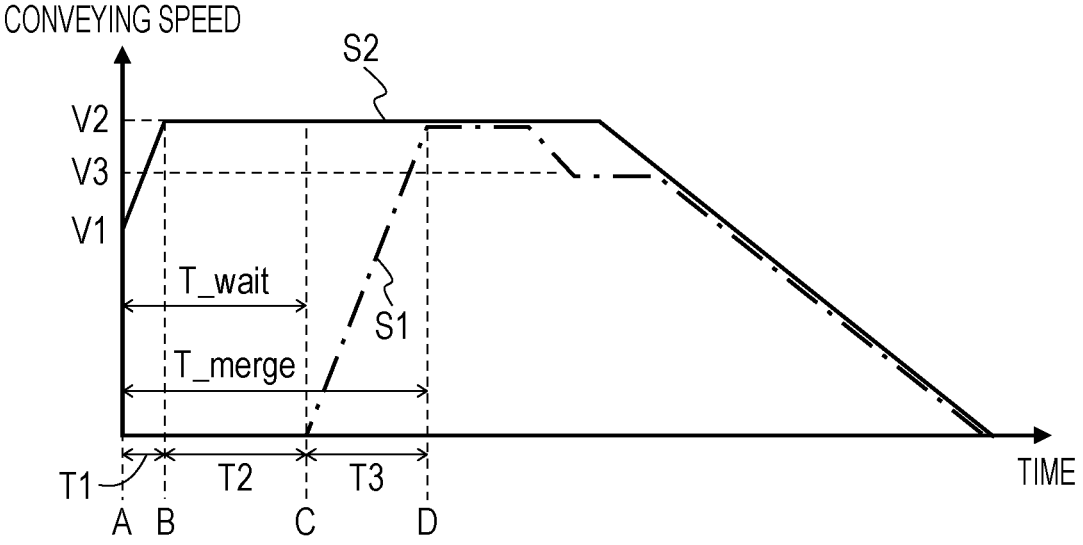

FIG. 7C illustrates a change in the speed of each of the sheets S1 and S2 during the operations illustrated in FIGS. 7A and 7B. In FIG. 7C, "A" represents the moment when the inlet sensor 27 detects the trailing edge of the sheet S2 as illustrated in FIG. 7A and, thus, the pre-branch rollers 22 start accelerating from the speed V1 to the speed V2 with a constant acceleration. In FIG. 7C, "B" represents the time the sheet S2 has completed accelerating to the speed V2. In FIG. 7C, "C" represents the time a predetermined time T_wait has elapsed since the inlet sensor 27 detected the trailing edge of the sheet S2, that is, the time the internal discharge rollers 26 start conveying the sheet S1 in the G2 direction. In FIG. 7C, "D" represents the time the relative speed between the sheets S1 and S2 becomes zero as illustrated in FIG. 7B.

Let T_merge denote the elapsed time from A to D. Let T1 denote the time required for the pre-branch rollers 22 to accelerate from the speed V1 to the speed V2 (the elapsed time from A to B). Let T2 denote the time from acceleration of the pre-branch rollers 22 to the speed V2 until start of the rotation of the internal discharge rollers 26 (the elapsed time from B to C). As can be seen from the definitions of T1, T2 and T_wait, T_wait=T1+T2. Let T3 denote the time required for the stopped sheet S1 to accelerate to the speed V2 with a constant acceleration (the elapsed time from C to D).

Let X2 denote the distance that the sheet S1 moves from the position in FIG. 7A to the position in FIG. 7B. Then, as can be seen from the above description, X2 is the distance that the sheet S1 moves from C to D in FIG. 7C and can be given by the following equation:

$$X2=(V2\times T3)/2 \quad (1).$$

In addition, let X1 denote the distance that the sheet S2 moves from the position in FIG. 7A to the position in FIG. 7B. Then, X1 is the distance that the sheet S2 moves from A to D in FIG. 7C and can be given by the following equation:

$$X1=(V1+V2)\times T1/2+V2\times(T2+T3) \quad (2).$$

From the positional relationship between the sheets S1 and S2 at the time in FIG. 7B, the following relationship holds:

$$L1-X1=L2-X2-Kt \quad (3).$$

Substituting equations (1) and (2) into equation (3) and expanding and rearranging the equation yields the following equation:

$$L1-L2+Kt=(T1/2)\times V1+(T1/2+T2+T3/2)\times V2 \quad (4).$$

Substituting T_wait=T1+T2 into the above equation (4) and rearranging the equation, the waiting time T_wait from when the trailing edge of the sheet S2 passes the inlet sensor 27 to when the internal discharge rollers 26 start conveying the sheet S1 is given for the protrusion amount Kt by the following equation:

$$T_\text{wait}=(L1-L2+Kt)/V2-(T1/2)\times V1/V2+(T1-T3)/2 \quad (5).$$

To align the leading and trailing edges of the sheets S1 and S2 and superpose the sheets S1 and S2, the waiting time T_wait can be calculated by setting Kt=0 in the above equation (5). By starting the conveyance of the sheet S1 by the internal discharge rollers 26 on the basis of the calculated T_wait, the sheet bundle S' in which the leading and trailing edges of the sheets S1 and S2 are aligned can be formed. In addition, by using the same value of T_wait when three or more sheets are superposed, a sheet bundle in which the leading and trailing edges of the sheets are aligned can be formed.

Control Example

Figure 6A:
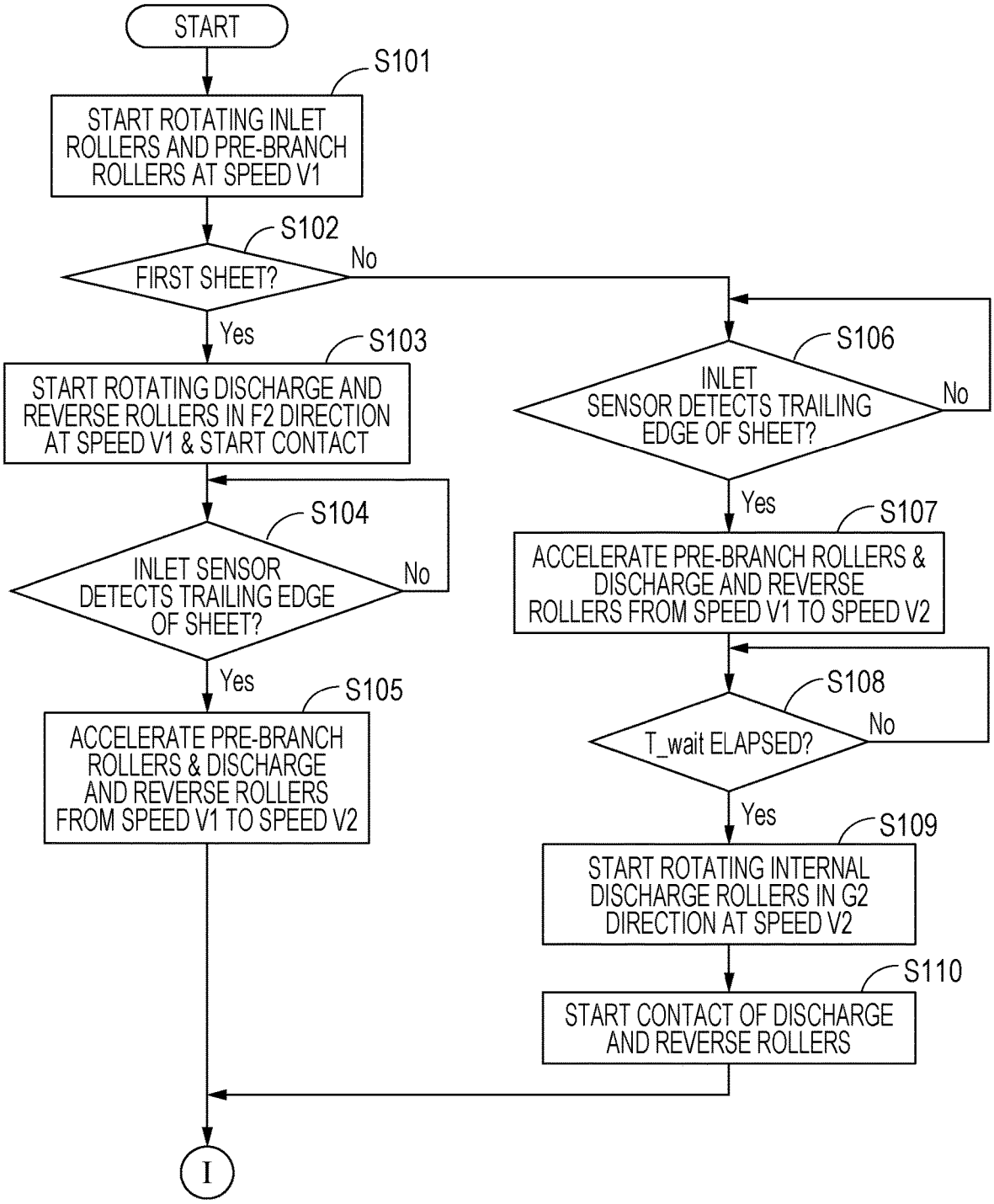
FIGS. 6A and 6B are a flowchart illustrating a control example of the superposition processing unit according to the embodiment.
Figure 6B:
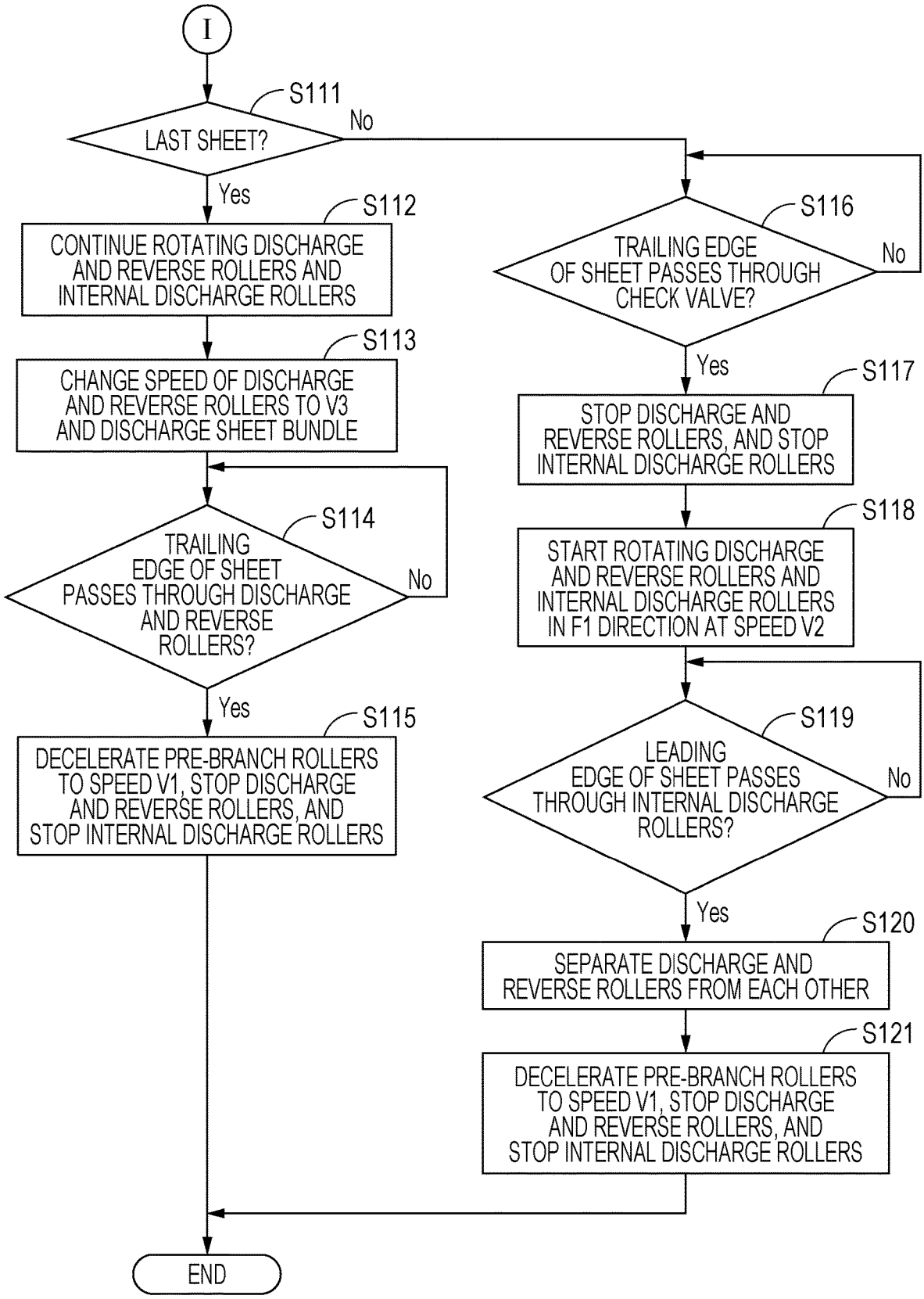

An example of a method for controlling the sheet processing apparatus 4 that achieves the superposed discharge operation described with reference to FIGS. 5A to 5G is described below with reference to the flowchart illustrated in FIGS. 6A and 6B. This flow is executed each time the main control unit 603 of the sheet processing apparatus 4 receives a notification from the video controller 601 that one sheet is discharged from the image forming apparatus 1. The steps of the flowchart are executed by the superposed conveying controller 711 illustrated in FIG. 4 unless otherwise specified.

In the following description, the term "first sheet" refers to a sheet conveyed first to the sheet processing apparatus 4 among the sheets to be superposed in the superposition processing unit 4B to form a sheet bundle. For example, when four sheets are superposed and discharged to the upper discharge tray 25, the sheet conveyed to the sheet processing apparatus 4 after the last sheet of the preceding sheet bundle (that is, the (4n+1)th sheet) is the first sheet. The term "last sheet" refers to a sheet that is conveyed to the sheet processing apparatus 4 last among the sheets to be superposed in the superposition processing unit 4B to form a sheet bundle (that is, the 4nth sheet in the above example).

In step S101, rotation of the inlet rollers 21 and the pre-branch rollers 22 is started at the speed V1. Thereafter, the processing proceeds to step S102. If the inlet rollers 21 and the pre-branch rollers 22 are already rotating at the speed V1, the rotation of the rollers is continued.

In step S102, it is determined whether the current sheet is a first sheet. If Yes, then the processing proceeds to step S103, and if No, the processing proceeds to step S106.

In step S103, the discharge and reverse rollers 24 are brought into contact with each other, and the rotation of the discharging and reversing rollers 24 is started in a direction in which the first sheet is conveyed toward the upper discharge tray 25 (the G2 direction) at the speed V1 (refer to the sheet S1 in FIG. 5A). The processing proceeds to step S104.

In step S104, it is determined whether the trailing edge of the first sheet has passed the inlet sensor 27. If Yes, the processing proceeds to step S105, and if No, the processing proceeds to step S104.

In step S105, the pre-branch rollers 22 and the discharge and reverse rollers 24 are accelerated to the speed V2 (refer to the sheet S1 in FIG. 5A). The processing proceeds to step S111.

In step S106, it is determined whether the trailing edge of the current sheet (one of the second and succeeding sheets) has passed the inlet sensor 27. If Yes, the processing proceeds to step S107, and if No, the processing proceeds to step S106.

In step S107, the pre-branch rollers 22 and the discharge and reverse rollers 24 are accelerated to the speed V2. As a result, the conveying speed of the current sheet is accelerated from the speed V1 to the speed V2 (refer to the sheet S2 in FIG. 5D). The processing proceeds to step S108.

In step S108, it is determined whether a predetermined time T_wait has elapsed since the time the trailing edge of the current sheet passed the inlet sensor 27. If Yes, the processing proceeds to step S109, and if No, the processing proceeds to step S108.

In step S109, rotation of the internal discharge rollers 26 is started again in the direction in which the sheet is conveyed toward the discharge and reverse rollers 24 (the F2 direction) at a speed V2 (refer to the sheet S1 in FIG. 5D). The processing proceeds to step S110.

In step S110, at the time the conveying speed of the sheets (a bundle) conveyed by the internal discharge rollers 26 and the conveying speed of the current sheet become equal, the upper roller 24*a* of the discharge and reverse rollers 24 is moved in the E2 direction so as to come into contact with the lower roller 24*b* (refer to FIG. 5E). As a result, the sheets (the bundle) conveyed by the internal discharge rollers 26 and the current sheet are nipped by the discharge and reverse rollers 24 at the same time (refer to FIG. 5E). The processing proceeds to step S111.

In step S111, it is determined whether the current sheet is the last sheet. If Yes, the processing proceeds to step S112, and if No, the processing proceeds to step S116.

In step S112, the sheet bundle including the last sheet is discharged to the upper discharge tray 25 (refer to FIG. 5F). That is, the sheet conveyance started in step S107 or S109 by using the discharge and reverse rollers 24 and the internal discharge rollers 26 is continued.

In step S113, when the trailing edge of the sheet bundle reaches the distance L from the discharge and reverse rollers 24, the conveying speed of the discharge and reverse rollers is changed to the speed V3, and the sheet bundle is discharged to the upper discharge tray 25. According to the present embodiment, the discharge speed V3 is set according to the number of sheets in a sheet bundle to be discharged.

In step S114, it is determined whether the trailing edge of the sheet bundle has passed through the discharge and reverse rollers 24. If Yes, the processing proceeds to step S115, and if No, the processing proceeds to step S114.

In step S115, the pre-branch rollers 22 is decelerated to the speed V1, and the discharge and reverse rollers 24 and the internal discharge rollers 26 are stopped. Thus, the flow ends. If the current sheet is the last sheet in the job (if no more sheets are conveyed from the image forming apparatus 1), the inlet rollers 21 and pre-branch rollers 22 are also stopped in step S115.

In step S116, it is determined whether the trailing edge of the current sheet (a sheet other than the last sheet) has passed through the check valve 23. If Yes, the processing proceeds to step S117, and if No, the processing proceeds to step S116.

In step S117, the discharge and reverse rollers 24 and the internal discharge rollers 26 are temporarily stopped (refer to the sheet S1 in FIG. 5B). The processing proceeds to step S118.

In step S118, rotation of the discharge and reverse rollers 24 and rotation of the internal discharge rollers 26 are started in a rotation direction for conveying the sheets (the bundle) in the direction after reversal (the F1 direction, G1 direction) at the speed V2 (refer to the sheet S1 in FIG. 5C). The processing proceeds to step S119.

In step S119, it is determined whether the leading edge of the sheets (the bundle) has passed through the internal discharge rollers 26. If Yes, the processing proceeds to step S120, and if No, the processing proceeds to step S119.

In step S120, the upper roller 24*a* is separated from the lower roller 24*b* of the discharge and reverse rollers 24. The processing proceeds to step S121.

In step S121, at the position where the leading edge of the sheets (the bundle) has passed through the internal discharge rollers 26 and has been conveyed by a predetermined distance, the pre-branch rollers 22 is decelerated to the speed V1, and the discharge and reverse rollers 24 and the internal discharge rollers 26 are stopped. Thus, the flow ends. As a result, the sheets (the bundle), which are the target of the superposed discharge operation and are still superposed on other sheets, are held while being nipped by the internal discharge rollers 26 (refer to the sheet S1 in FIG. 5D).

As described in step S113, according to the present embodiment, the discharge speed V3 is set according to the sheet bundle to be discharged. The reason for this setting is described below with reference to FIG. 8. The flight distance of the sheet bundle discharged by the discharge and reverse rollers 24 varies according to the number of sheets in a bundle. If an air resistance R is not taken into account, the flight trajectory of the sheet bundle is determined by the initial speed V3 and a discharge angle θ at the time of discharge of a sheet material. Therefore, the flight distance is constant regardless of the number of sheets in a bundle. In reality, the air resistance R acts on the sheet material, and the discharge trajectory of the sheet bundle is changed for each number of sheets in the bundle.

Figure 8:
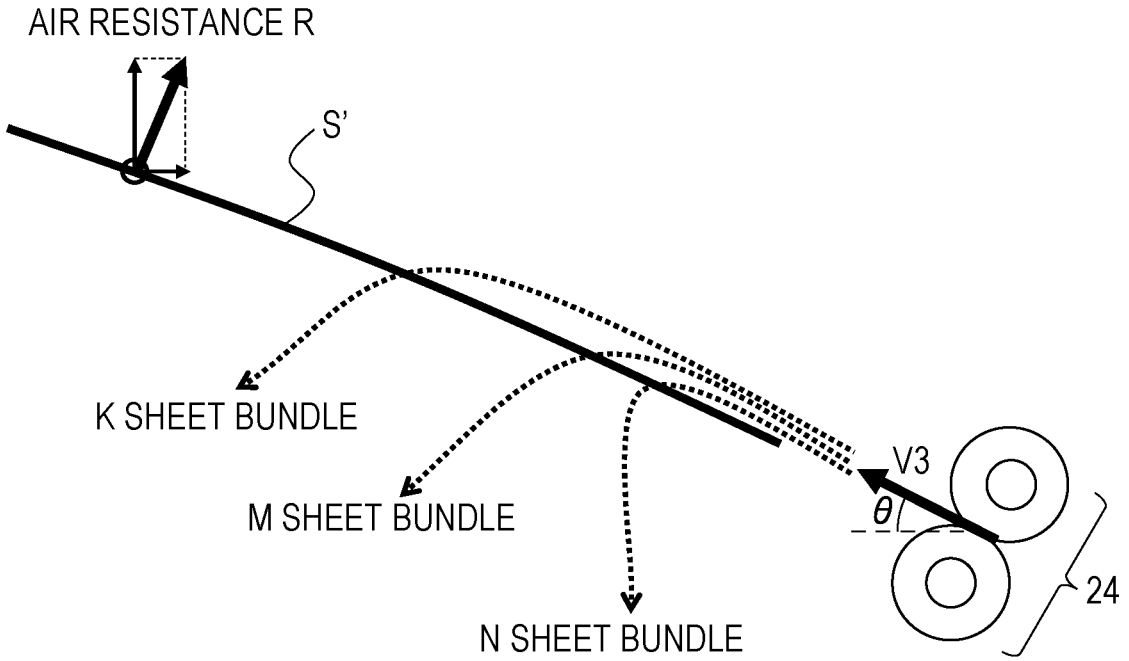
FIG. 8 illustrates the different discharge trajectories of bundles of sheets due to different discharge speeds according to the embodiment.

For this reason, if the discharge speed V3 is constant regardless of the number of sheets in a bundle, variations occur in the flight distance of the sheet bundle from the discharge and reverse rollers 24, as illustrated in FIG. 8, leading to a degradation of stackability or a discharge failure. If the flight distance of the discharged sheet bundle is too large, the sheet bundle may jump out the sheets already stacked on the upper discharge tray 25. If the flight distance of the sheet bundle is insufficient, the trailing edge of the sheet bundle is caught by the discharge and reverse rollers 24, which causes a discharge failure.

Figure 9A:
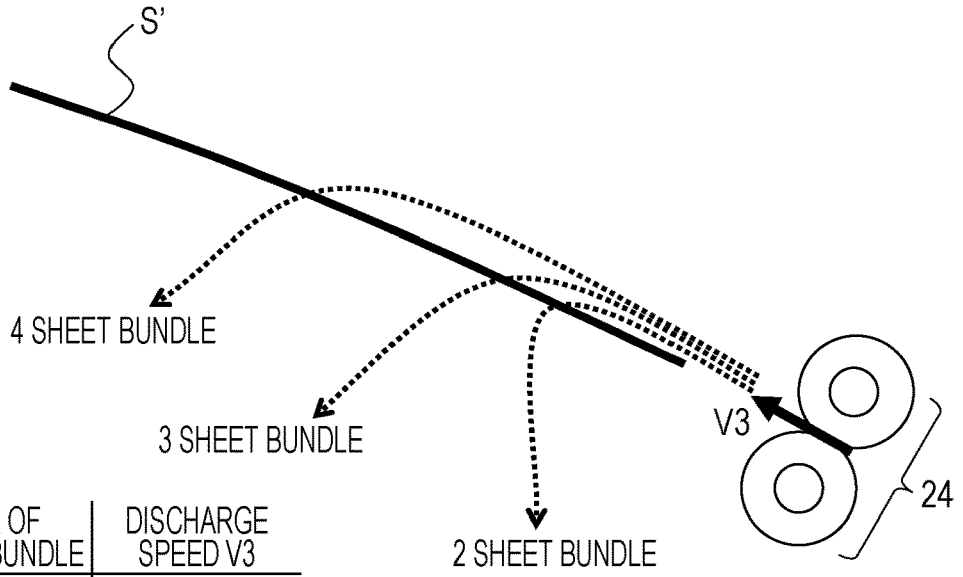
FIG. 9A illustrates the discharge trajectories when the discharge speed is set constant regardless of the number of sheets in a bundle.
Figure 9B:
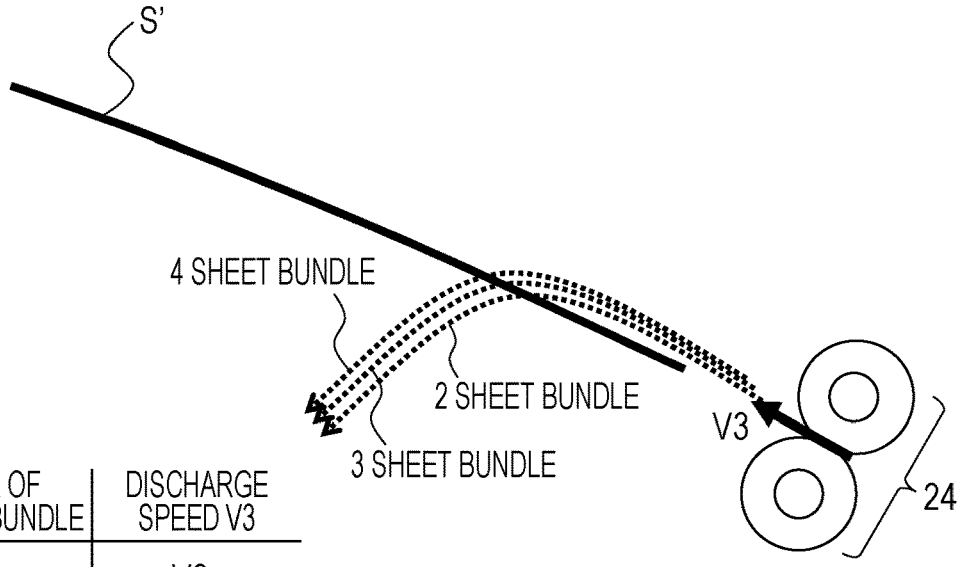
FIG. 9B illustrates the discharge trajectories when the discharge speed is changed according to the number of sheets in a bundle.

Therefore, according to the present embodiment, the discharge speed V3 is set according to the number of sheets in a bundle to be discharged to avoid the above-described issues. FIG. 9A illustrates the flight trajectories when the discharge speed is set to a constant value regardless of the number of sheets in a bundle, and FIG. 9B illustrates the flight trajectories when the discharge speed is changed according to the number of sheets in a bundle.

As illustrated in FIG. 9A, when the discharge speed is set to a constant value (a discharge speed V31) regardless of the number of sheets in a bundle, the flight distance of the bundle from the discharge and reverse rollers 24 varies. Accordingly, as illustrated in FIG. 9B, different discharge speeds are set. That is, the discharge speed for the 2 sheet bundle is set to V32, the discharge speed for the 3 sheet bundle is set to V33, and the discharge speed for the 4 sheet bundle is set to V34. As a result, as illustrated in FIG. 9B, the flight distance of the sheet bundle from the discharge and reverse rollers 24 can be made constant. As the number of sheets in a bundle increases, the mass of the bundle increases. Thus, the bundle of sheets is less likely to be influenced by the air resistance, so the flight distance of the bundle of sheets increases. Therefore, the discharge speed V3 is set such that the discharge speed V3 decreases with increasing number of sheets in the bundle.

That is, when the number of sheets in the sheet bundle is a first number of sheets (for example, 2 sheets), the discharge speed V3 is set to a first discharge speed (for example, a discharge speed V32). When the number of sheets in the sheet bundle is a second number of sheets that is greater than the first number of sheets (for example, 3 sheets), the discharge speed V3 is set to a second discharge speed that is lower than the first discharge speed (for example, a discharge speed V33).

As a result, regardless of the number of sheets in the bundle, the sheet bundle can be discharged to the target position, improving the stackability. Note that the discharge speed V3 can be changed by the time the trailing edge of the sheet bundle passes through the discharge and reverse rollers 24 at the latest.

Instead of changing the discharge speed V3 according to the number of sheets in the bundle, a threshold may be set for the number of sheets in a bundle. For example, when the number of sheets in the bundle is 2 or 3, the discharge speed V3 may be set to the first discharge speed. When the number of sheets in the bundle is 4 (which is greater than or equal to the threshold), the discharge speed V3 may be set to the second discharge speed (in this case, the threshold is 4 sheets). The discharge speed V3 can be appropriately set according to the discharge angle of the discharge and reverse rollers 24, the positional relationship between the upper discharge tray 25 and the discharge and reverse rollers 24, and the like.

Figure 10A:
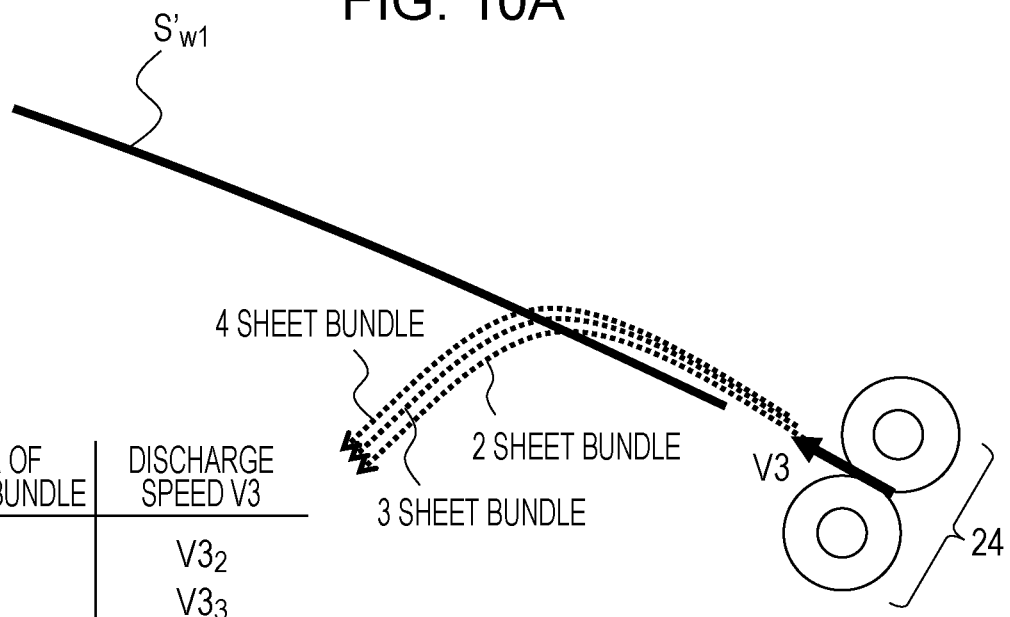
FIGS. 10A and 10B illustrate the difference in discharge trajectory caused by the difference in basis weight.
Figure 10B:
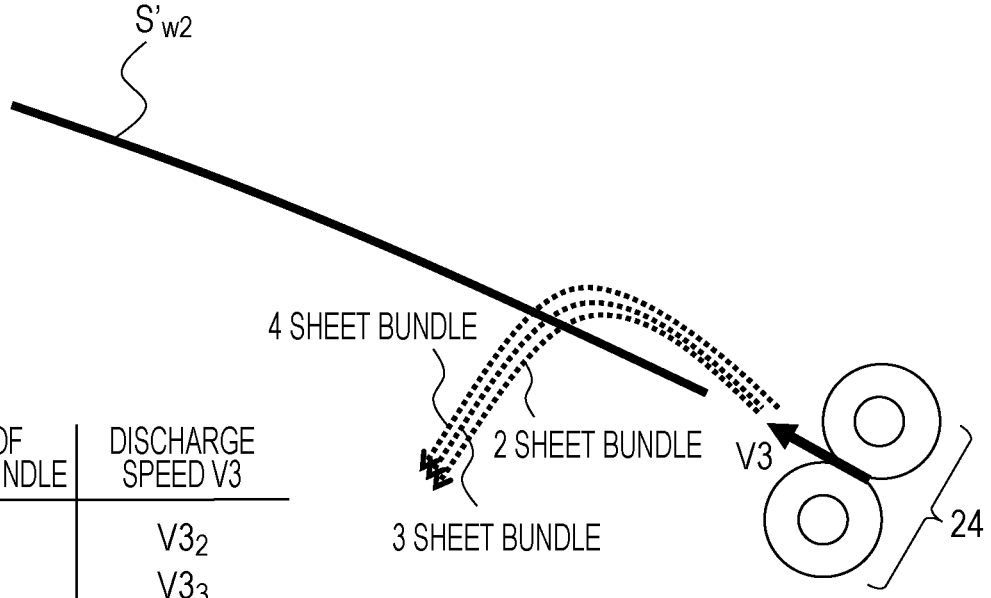

In some cases, the flight distance changes according to the basis weight of the sheet, giving an impact on the stackability. For example, FIG. 10A illustrates the discharge trajectory of a sheet bundle S'w1 with a basis weight of W1. The discharge speed V3 is set to one of V32 to V34 according to the number of sheets in the bundle. In this setting, when a sheet bundle S'w2 with a basis weight of W2 is discharged, the flight distance differs from that of the sheet bundle S'w1 with a basis weight of W1 (FIG. 10B). More specifically, the influence of air resistance increases with decreasing basis weight of the sheets and, thus, the flight distance of the bundle of the sheets decreases.

Accordingly, when a bundle (a first sheet bundle) consisting of a plurality of sheets of a first basis weight is formed, the discharge speed V3 is set to a third discharge speed. When a bundle (a second sheet bundle) consisting of a plurality of sheets with a second basis weight (the sheets with a basis weight that is less than the first basis weight) is formed, the discharge speed V3 is set to a fourth discharge speed. The fourth discharge speed is set so as to be greater than the third discharge speed.

Figure 11A:
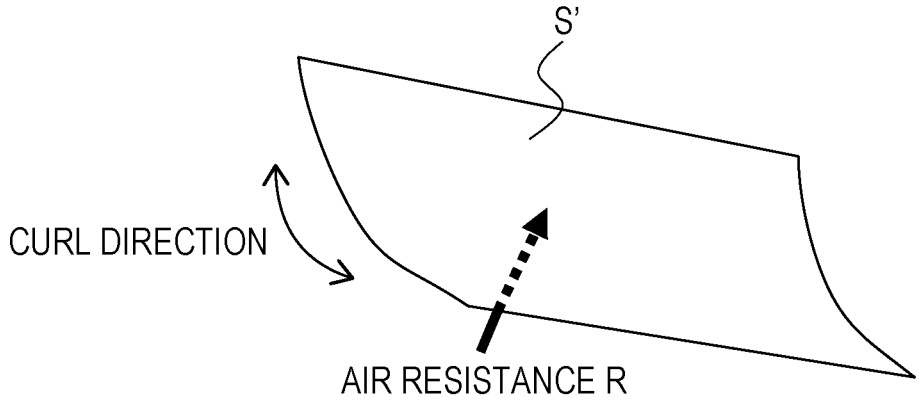
FIGS. 11A and 11B illustrate the curl directions of sheets.
Figure 11B:
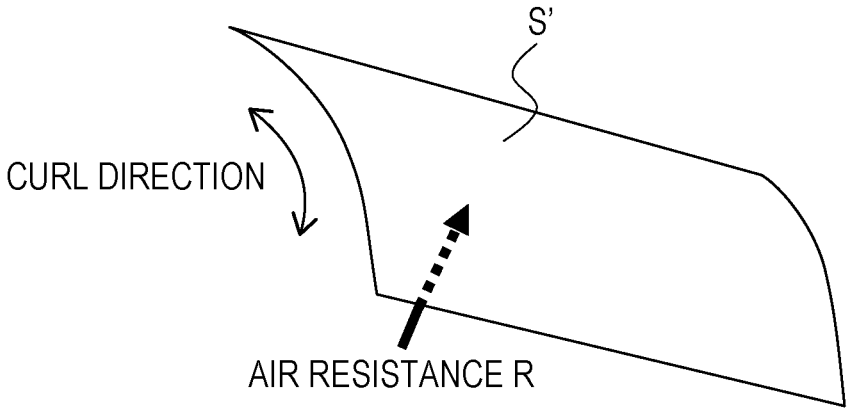

In addition, in some cases, the flight distance varies according to the size of the sheet, giving an impact on the stackability. In this case, the setting of the discharge speed V3 may be changed according to the sheet size and the number of sheets in the same manner as described above. Furthermore, in some cases, the curl direction of the sheets varies according to the print mode (for example, double-sided printing or single-sided printing) or the medium type (FIGS. 11A and 11B). The effect of the air resistance R on a sheet bundle may vary according to the curl direction, resulting in a difference in flight distance. As a result, variations in the flight distance of the discharged sheet bundle may occur, and the stackability may deteriorate. In this case, the setting of the discharge speed V3 may be changed according to the print mode or the medium type and the number of sheets in the bundle in the same manner as described above.

As described above, according to the present embodiment, when a plurality of sheets that are continuously conveyed are discharged onto the first stacking member, the superposition processing unit 4B can superpose the plurality of sheets while aligning the edges of the sheets and, thereafter, discharge the sheets. As a result, the stackability of the sheets on the first stacking member can be improved while maintaining the productivity. In addition, when the superposition processing unit 4B superposes a plurality of sheets while aligning the edges of the sheets and, thereafter, discharge the sheets, the discharge speed can be changed according to the number of sheets that form the bundle. As a result, the flight distance of the sheet bundle discharged onto the first stacking member from the discharge and reverse rollers 24 can be made constant and, thus, the sheet stackability can be improved.

While the configuration example of the present embodiment has been described with reference to the maximum number of sheets that can be superposed by the superposition processing unit 4B (the number of superposable sheets) being five, the number of superposable sheets can be appropriately changed according to the particular configuration of the superposition processing unit 4B and the performance required for the superposition processing unit 4B.

Buffer Operation Performed by Sheet Processing Device

The superposition processing unit 4B of the present embodiment can also operate as a buffer unit that superposes and holds sheets received from the image forming apparatus 1 while the sheet processing device 71 is processing sheets. By performing the buffer operation, collision of sheets in the sheet processing device 71 is avoided without decreasing the productivity of the image forming apparatus 1. As a result, the productivity of the image forming system 1S is improved.

When the buffer operation is performed, the operation performed by the superposition processing unit 4B is basically common to the superposed discharge operation, except that the bundle of superposed sheets is conveyed to the sheet processing device 71 via the internal discharge path 82. That is, in the operations illustrated in FIGS. 5A to 5G, the bundle of superposed sheets illustrated in FIG. 5F is not discharged to the upper discharge tray 25 but is conveyed to the sheet processing device 71 via, for example, the internal discharge rollers 26. In addition, after the sheet bundle is conveyed to the sheet processing device 71, the succeeding sheets for which buffering is not needed are switched back one by one by the discharge and reverse rollers 24, and the sheets are conveyed to the sheet processing device 71.

In the buffer operation, a protrusion amount Kt (FIG. 7B) may be set so that the leading edges of the superposed sheets are shifted from each other by a predetermined distance. In this case, it is desirable to set the protrusion amount Kt so that the lower sheet (the sheet S1 in FIG. 7B) in the sheet processing device 71 protrudes further downstream in the sheet conveying direction toward the sheet processing device 71. In this way, the half-moon roller 33 can be brought into contact with each of the sheets in the bundle superposed through the buffer operation, and an aligning operation can be effectively performed.

As described above, the superposition processing unit 4B of the present embodiment has the function of performing a superposed discharge operation when discharging sheets to the outside of the sheet processing apparatus 4 without the processing performed by the sheet processing device 71 and also has the function of buffering sheets to be processed by the sheet processing device 71. As a result, the size and cost of the apparatus can be reduced as compared with the configuration including two mechanisms for superposing sheets in order to achieve the above-described two functions.

Modification

According to the present embodiment, the internal discharge path 82 serving as the second conveying path communicates with the sheet processing device 71. However, a configuration in which the second conveying path communicates with a discharge destination other than the sheet processing device 71 may be employed. For example, the sheet processing device 71 may be removed, and a sheet conveyed via the internal discharge path 82 may be discharged to the lower discharge tray 37 without being processed. Alternatively, an configuration may be employed in which the second conveying path has a dead end and does not communicate with the outside of the sheet processing apparatus 4.

In addition, while the present embodiment has been described with reference to the sheet discharge apparatus of the sheet processing apparatus 4 provided separately from the image forming apparatus 1, the present technology is applicable to a sheet discharge apparatus that discharges a sheet from the image forming apparatus 1 or other apparatuses that handle sheets.

In addition, according to the present embodiment, the bundle discharge rollers 36 for discharging the sheets processed by the sheet processing device 71 to the lower discharge tray 37 can be applied as the discharge device. When the bundle discharge rollers 36 discharge a sheet bundle, the discharge speed may be appropriately set according to the number of sheets that form the sheet bundle.

OTHER EMBODIMENTS

The present invention can be also implemented by performing the following processing. That is, a program that provides at least one of the functions of the above-described embodiment is supplied to a system or apparatus via a network or a storage medium, and at least one processor of the computer of the system or apparatus reads and executes the program. Alternatively, the present invention is implemented by using a circuit (for example, an application specific integrated circuit (ASIC)) that provides the at least one function.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-189216 filed Nov. 22, 2021, which is hereby incorporated by reference herein in its entirety.

What is claimed is:

1. A sheet discharge apparatus comprising:

a first stacking member provided outside an apparatus main body;

a first conveying device disposed in a first conveying path extending toward the first stacking member in the apparatus main body, wherein the first conveying device conveys a sheet to the first stacking member;

a discharge device configured to receive the sheet conveyed by the first conveying device and discharge the sheet to the first stacking member, wherein the discharge device discharges a plurality of the sheets each conveyed from the first conveying device in the form of a bundle of sheets, wherein the discharge device is a second conveying device disposed downstream of the first conveying device in the first conveying path, and wherein the discharge device is capable of reversing the conveying direction of the sheet received from the first conveying device and conveying the sheet to a second conveying path that branches from the first conveying path between the first conveying device and the second conveying device;

a sheet processing device configured to receive a sheet that is not discharged by the discharge device and processes the received sheet;

a second stacking member provided outside the apparatus main body, wherein the sheet processed by the sheet processing device is stacked on the second stacking member;

a detection member configured to detect a sheet passing through the first conveying path;

a third conveying device disposed in the second conveying path, wherein the third conveying device receives and conveys the sheet reversed by the second conveying device; and a controller configured to control the first conveying device and the discharge device to perform a bundle discharge operation for discharging the bundle of sheets from the discharge device onto the first stacking member, wherein the controller sets a discharge speed at which a sheet is discharged by the discharge device to a first discharge speed when the bundle of sheets includes a first number of sheets and sets the discharge speed to a second discharge speed that is lower than the first discharge speed when the bundle of sheets includes a second number of sheets that is greater than the first number of sheets, wherein the controller controls the first conveying device, the second conveying device, and the third conveying device to perform the bundle discharge operation, wherein in the bundle discharge operation, after a first sheet conveyed in the first conveying path is delivered to the third conveying device via the second conveying device, conveyance of the first sheet by the third conveying device is stopped and, when a predetermined time elapses since the detection member detects a second sheet that is subsequently conveyed in the first conveying path, the first sheet is conveyed to the second conveying device by the third conveying device, so that a bundle of the first and second sheets superposed with edges of the first sheet and the second sheet in the sheet conveying direction aligned is formed and discharged onto the first stacking member by the second conveying device.

2. The sheet discharge apparatus according to claim 1, wherein in the bundle discharge operation, the controller is capable of forming the bundle of three or more sheets including the first sheet and the second sheet and discharging the bundle of sheets to the first stacking member by using the second conveying device.

3. The sheet discharge apparatus according to claim 1, wherein when executing a job to discharge a predetermined number of sheets to the first stacking member, the controller changes the number of sheets in the bundle of sheets formed through the bundle discharge operation according to the predetermined number of sheets so that each of the predetermined number of sheets is always included in the bundle of two or more sheets formed through the bundle discharge operation and is discharged to the first stacking member.

4. The sheet discharge apparatus according to claim 1, wherein the sheet processing device performs a binding operation on the sheet conveyed via the second conveying path.

5. The sheet discharge apparatus according to claim 4, wherein when not performing the bundle discharge operation, the controller superposes a plurality of sheets conveyed from an outside of the sheet processing apparatus to the first conveying path by using the first conveying device, the second conveying device, and the third conveying device while the sheet processing device is processing sheets and, after the processing performed by the sheet processing device, the controller conveys the plurality of sheets to the sheet processing device.

6. The sheet discharge apparatus according to claim 4, wherein the sheet processing device includes an intermediate stacking member disposed in the apparatus main body, a reference member disposed downstream of the intermediate stacking member in a sheet discharge direction from the second conveying path to the intermediate stacking member, a moving member configured to move a sheet discharged to the intermediate stacking member toward the reference member and align the sheet, and an extrusion member configured to extrude the sheets processed by the sheet processing device in a direction opposite the discharge direction, and wherein the second stacking member is disposed below the first stacking member.

7. An image forming system comprising:

an image forming apparatus configured to form an image on a sheet; and the sheet discharge apparatus according to claim 4.

* * * * *